US007614958B2

(12) United States Patent
Weston et al.

(10) Patent No.: US 7,614,958 B2
(45) Date of Patent: Nov. 10, 2009

(54) INTERACTIVE QUEST GAME

(75) Inventors: Denise Chapman Weston, Wakefield, RI (US); Jonathan A. Barney, Newport Beach, CA (US); Rick A. Briggs, Springfield, IL (US)

(73) Assignee: Creative Kingdoms, LLC, Wakefield, RI (US)

( * ) Notice: Subject to any disclaimer, the term of this patent is extended or adjusted under 35 U.S.C. 154(b) by 458 days.

(21) Appl. No.: 10/298,170

(22) Filed: Nov. 15, 2002

(65) Prior Publication Data

US 2004/0077423 A1 Apr. 22, 2004

Related U.S. Application Data

(60) Provisional application No. 60/332,484, filed on Nov. 16, 2001.

(51) Int. Cl.

| | |
|---|---|
| ***A63F 13/10*** | (2006.01) |
| ***A63F 13/12*** | (2006.01) |
| ***A63F 13/02*** | (2006.01) |
| ***A63F 7/22*** | (2006.01) |
| ***A63F 7/30*** | (2006.01) |
| ***A63F 7/32*** | (2006.01) |
| ***A63F 7/40*** | (2006.01) |
| ***A63G 31/02*** | (2006.01) |
| ***E04H 3/10*** | (2006.01) |

(52) U.S. Cl. ..... 473/62; 463/15; 463/23; 463/29; 463/39; 473/57; 473/94; 473/133; 473/134; 473/136

(58) Field of Classification Search ..... 463/15, 463/23, 29, 39

See application file for complete search history.

(56) References Cited

U.S. PATENT DOCUMENTS 3,395,920 A 8/1968 Moe (Continued)

FOREIGN PATENT DOCUMENTS

EP 0546844 6/1993

(Continued)

OTHER PUBLICATIONS

U.S. Appl. No. 60/273,476, published as U.S. patent 7,052,391 B1.*

(Continued)

*Primary Examiner*—Peter DungBa Vo
*Assistant Examiner*—Matthew D. Hoel
(74) *Attorney, Agent, or Firm*—Knobbe, Martens, Olson & Bear, LLP

(57) ABSTRACT

A gaming system and method of game play is provided wherein the gaming is earned out within a themed physical play space comprising an existing or specially configured entertainment facility or play structure. The game utilizes electronically identifiable objects, such as colored balls, shaped objects, cards, bands, tags and/or the like, to provide an interactive game play experience generally simulative of a computer adventure game experience. Play participants are challenged to work and cooperate with other play participants to find identified objects, clues or other information for use in solving various puzzles or problems that present encumbrances inhibiting players' advancement in the game. Optionally, each play participant possesses a unique RFID band, card or the like, that electronically identifies the play participant and enables the play system to award and track points or other rewards to successful play participants individually or working with other play participants as a team.

20 Claims, 19 Drawing Sheets

U.S. PATENT DOCUMENTS

| | | | | |
|---|---|---|---|---|
| 3,707,055 | A | 12/1972 | Pearce | |
| 3,795,805 | A * | 3/1974 | Swanberg et al. | 250/226 |
| 3,949,364 | A * | 4/1976 | Clark et al. | 235/375 |
| 3,997,156 | A | 12/1976 | Barlow et al. | |
| 4,063,111 | A | 12/1977 | Dobler | |
| 4,171,737 | A * | 10/1979 | McLaughlin | 194/210 |
| 4,282,681 | A | 8/1981 | McCaslin | |
| 4,296,929 | A | 10/1981 | Meyer et al. | |
| 4,412,205 | A | 10/1983 | Von Kemenczky | |
| 4,678,450 | A | 7/1987 | Scolari et al. | |
| 4,858,930 | A | 8/1989 | Sato | |
| 4,891,032 | A | 1/1990 | Davis | |
| 4,910,677 | A | 3/1990 | Remedio et al. | |
| 4,967,321 | A | 10/1990 | Cimock | |
| 5,036,442 | A | 7/1991 | Brown | |
| 5,114,155 | A | 5/1992 | Tillery et al. | |
| 5,114,344 | A * | 5/1992 | Fumagalli et al. | 434/128 |
| 5,127,657 | A * | 7/1992 | Ikezawa et al. | 463/5 |
| 5,194,048 | A | 3/1993 | Briggs | |
| 5,223,698 | A * | 6/1993 | Kapur | 235/375 |
| 5,236,200 | A | 8/1993 | McGregor et al. | |
| 5,319,548 | A | 6/1994 | Germain | |
| 5,320,358 | A | 6/1994 | Jones | |
| 5,356,343 | A | 10/1994 | Lovetere | |
| 5,365,214 | A | 11/1994 | Angott et al. | |
| 5,378,197 | A | 1/1995 | Briggs | |
| 5,382,026 | A | 1/1995 | Harvard et al. | |
| 5,411,269 | A | 5/1995 | Thomas | |
| 5,482,510 | A | 1/1996 | Ishii et al. | |
| 5,498,002 | A | 3/1996 | Gechter | |
| 5,550,721 | A | 8/1996 | Rapisarda | |
| 5,580,319 | A | 12/1996 | Hamilton | |
| 5,587,740 | A | 12/1996 | Brennan | |
| 5,651,049 | A | 7/1997 | Easterling et al. | |
| 5,655,053 | A | 8/1997 | Renie | |
| 5,674,128 | A | 10/1997 | Holch et al. | |
| 5,751,273 | A | 5/1998 | Cohen | |
| 5,757,305 | A | 5/1998 | Xydis | |
| 5,770,533 | A | 6/1998 | Franchi | |
| 5,785,592 | A | 7/1998 | Jacobsen | |
| 5,786,626 | A | 7/1998 | Brady et al. | |
| 5,810,666 | A | 9/1998 | Mero et al. | |
| 5,811,896 | A | 9/1998 | Grad | |
| 5,830,065 | A | 11/1998 | Sitrick | |
| 5,835,576 | A | 11/1998 | Katz | |
| 5,836,817 | A | 11/1998 | Acres et al. | |
| 5,851,149 | A | 12/1998 | Xidos et al. | |
| 5,853,332 | A * | 12/1998 | Briggs | 472/128 |
| 5,855,483 | A | 1/1999 | Collins et al. | |
| 5,865,680 | A | 2/1999 | Briggs | |
| 5,924,695 | A | 7/1999 | Heykoop | |
| 5,942,969 | A | 8/1999 | Wicks | |
| 5,944,533 | A | 8/1999 | Wood | |
| 5,946,444 | A | 8/1999 | Evans et al. | |
| 5,963,136 | A | 10/1999 | O'Brien | |
| 5,964,660 | A | 10/1999 | James et al. | |
| 5,971,270 | A | 10/1999 | Barna | |
| 5,996,033 | A | 11/1999 | Chiu-Hao | |
| 6,009,458 | A | 12/1999 | Hawkins et al. | |
| 6,012,984 | A | 1/2000 | Roseman | |
| 6,025,830 | A | 2/2000 | Cohen | |
| 6,075,443 | A | 6/2000 | Schepps et al. | |
| 6,129,549 | A | 10/2000 | Thompson | |
| 6,132,318 | A | 10/2000 | Briggs | |
| 6,150,947 | A | 11/2000 | Shima | |
| 6,160,986 | A | 12/2000 | Gabai et al. | |
| 6,162,122 | A * | 12/2000 | Acres et al. | 463/29 |
| 6,162,123 | A | 12/2000 | Woolston | |
| 6,174,242 | B1 | 1/2001 | Briggs et al. | |
| 6,196,893 | B1 | 3/2001 | Casola et al. | |
| 6,200,216 | B1 | 3/2001 | Peppel | |
| 6,206,745 | B1 | 3/2001 | Gabai et al. | |
| 6,206,782 | B1 * | 3/2001 | Walker et al. | 463/25 |
| 6,210,287 | B1 | 4/2001 | Briggs | |
| 6,214,155 | B1 * | 4/2001 | Leighton | 156/298 |
| 6,220,965 | B1 | 4/2001 | Hanna et al. | |
| 6,231,451 | B1 | 5/2001 | Briggs | |
| 6,234,803 | B1 | 5/2001 | Watkins | |
| RE37,220 | E | 6/2001 | Rapisarda et al. | |
| 6,254,101 | B1 | 7/2001 | Young | |
| 6,264,202 | B1 | 7/2001 | Briggs | |
| 6,273,425 | B1 | 8/2001 | Westfall et al. | |
| 6,280,328 | B1 | 8/2001 | Holch et al. | |
| 6,283,871 | B1 | 9/2001 | Briggs | |
| 6,290,566 | B1 | 9/2001 | Gabai et al. | |
| 6,302,793 | B1 | 10/2001 | Fertitta, III et al. | |
| 6,328,648 | B1 | 12/2001 | Walker et al. | |
| 6,330,427 | B1 | 12/2001 | Tabachnik | |
| 6,352,478 | B1 | 3/2002 | Gabai et al. | |
| 6,356,867 | B1 | 3/2002 | Gabai et al. | |
| 6,368,177 | B1 | 4/2002 | Gabai et al. | |
| 6,369,908 | B1 | 4/2002 | Frey et al. | |
| 6,371,375 | B1 | 4/2002 | Ackley et al. | |
| 6,375,578 | B1 | 4/2002 | Briggs | |
| 6,404,409 | B1 | 6/2002 | Solomon | |
| 6,409,379 | B1 | 6/2002 | Gabathuler et al. | |
| 6,414,589 | B1 | 7/2002 | Angott et al. | |
| 6,463,257 | B1 | 10/2002 | Wood | |
| 6,463,859 | B1 | 10/2002 | Ikezawa et al. | |
| 6,482,067 | B1 | 11/2002 | Pickens | |
| 6,490,409 | B1 | 12/2002 | Walker | |
| 6,494,457 | B2 | 12/2002 | Conte et al. | |
| 6,509,217 | B1 | 1/2003 | Reddy | |
| 6,525,660 | B1 | 2/2003 | Surintrspanont | |
| 6,526,158 | B1 | 2/2003 | Goldberg | |
| 6,551,188 | B2 | 4/2003 | Toyama et al. | |
| 6,569,023 | B1 | 5/2003 | Briggs | |
| 6,589,120 | B1 | 7/2003 | Takahashi | |
| 6,595,863 | B2 * | 7/2003 | Chamberlain et al. | 473/132 |
| 6,607,123 | B1 * | 8/2003 | Jollifee et al. | 235/375 |
| 6,609,969 | B1 * | 8/2003 | Luciano et al. | 463/16 |
| 6,626,728 | B2 | 9/2003 | Holt | |
| 6,632,142 | B2 | 10/2003 | Keith | |
| 6,634,949 | B1 * | 10/2003 | Briggs et al. | 463/42 |
| 6,682,074 | B2 | 1/2004 | Weston | |
| 6,709,336 | B2 | 3/2004 | Siegel et al. | |
| 6,746,334 | B1 | 6/2004 | Barney | |
| 6,761,637 | B2 | 7/2004 | Weston et al. | |
| 6,773,344 | B1 | 8/2004 | Gabai et al. | |
| 7,040,998 | B2 * | 5/2006 | Jolliffe et al. | 473/151 |
| 7,052,391 | B1 * | 5/2006 | Luciano, Jr. | 463/3 |
| 7,056,221 | B2 * | 6/2006 | Thirkettle et al. | 473/168 |
| 7,059,974 | B1 * | 6/2006 | Golliffe et al. | 473/351 |
| 7,160,196 | B2 * | 1/2007 | Thirkettle et al. | 473/132 |
| 7,337,965 | B2 * | 3/2008 | Thirkettle et al. | 235/435 |
| 2001/0018361 | A1 * | 8/2001 | Acres | 463/27 |
| 2002/0005787 | A1 | 1/2002 | Gabai et al. | |
| 2002/0032067 | A1 | 3/2002 | Barney | |
| 2002/0038267 | A1 | 3/2002 | Can et al. | |
| 2002/0052238 | A1 | 5/2002 | Muroi | |
| 2002/0058459 | A1 | 5/2002 | Holt | |
| 2002/0068500 | A1 | 6/2002 | Gabai et al. | |
| 2002/0107591 | A1 | 8/2002 | Gabai et al. | |
| 2002/0123377 | A1 * | 9/2002 | Shulman | 463/13 |
| 2002/0128056 | A1 * | 9/2002 | Kato | 463/9 |
| 2002/0158751 | A1 | 10/2002 | Bormaster | |
| 2002/0193047 | A1 | 12/2002 | Weston | |
| 2003/0013513 | A1 * | 1/2003 | Rowe | 463/20 |
| 2003/0069077 | A1 | 4/2003 | Korienek | |
| 2003/0106455 | A1 | 6/2003 | Weston | |
| 2003/0144047 | A1 | 7/2003 | Sprogis | |
| 2003/0193572 | A1 | 10/2003 | Wilson et al. | |
| 2004/0033833 | A1 | 2/2004 | Briggs et al. | |
| 2004/0092311 | A1 | 5/2004 | Weston et al. | |

| | | | |
|---|---|---|---|
| 2004/0198517 | A1 | 10/2004 | Briggs |
| 2004/0204240 | A1 | 10/2004 | Barney |
| 2005/0143173 | A1 | 6/2005 | Barney et al. |
| 2006/0154726 | A1 | 7/2006 | Weston et al. |

FOREIGN PATENT DOCUMENTS

| | | | | |
|---|---|---|---|---|
| JP | 2001-058484 | A | * | 3/2001 |
| WO | WO 97/28864 | | | 8/1997 |
| WO | WO 02/47013 | | | 6/2002 |
| WO | WO 03/043709 | | | 5/2003 |

OTHER PUBLICATIONS

Digital ID Cards Wall Street Journal Jun. 2001.

Pajama Sam: No Need To Hide When It's Dark Outside Infogames, Sept. 6, 2002.

"Raise High the 3D Roof Beam: Kids shape these PC games as they go along." By Anne Field, article as featured in Business Week 2001.

Tech Designers Rethink Toys: Make Them Fun. Wall Street Journal, Dec. 17, 2001.

"212 Series of Decoders" HT12D/HT12F by Holtek-Product Specification (Nov. 2002).

"212 Series Encoders" HT12A/HT12E by Holtek-Product Specification (Apr. 2000).

"Enchanted Spell-Casting Sorcerers Wand" by Ken Holt as featured on www.inventionconnection.com online advertisement (Dec. 2002).

"Micro Tilt Switch" D6B by Omron® Product Specification.

"Owl Magic Wand and Owl Magic Orb" Press Release by Emerald Forest Toys (Nov. 2001).

"Serial-in Parallel-out Shift Register" SN54/74LS164 by Motorola-Product Specification.

"The Magic Labs Conjure Wands" as featured on www.magic-lab.com Product Specification Dec. 2002.

"Tilt Switch" by Fuji & Co. as featured on www.fuji-piezo.com online advertisement May 2001.

"Toy Wand Manufacturer Selects MEMSIC Sensor: Magic Labs cuts costs with MEMSIC sensor" Press Release by MEMSIC, Inc. as featured on www.memsic.com May 2002.

PCT International Search Report and Written Opinion mailed Aug. 26, 2004, App. No. PCT/USO4/08912, 10 pages.

* cited by examiner

INTERACTIVE QUEST GAME

RELATED APPLICATIONS

This application claims the benefit of U.S. Provisional Application No. 60/332,484, filed Nov. 16, 2001, titled "QUEST GAME".

BACKGROUND OF THE INVENTION

1. Field of the Invention

The present invention relates to interactive games and, in particular, to interactive games and play systems utilizing themed play objects such as tagged or electronically-identifiable objects to provide a unique interactive game play experience.

2. Description of the Related Art

Family entertainment centers, play structures and other similar facilities are well known for providing play and interaction among play participants playing in, or around an entertainment facility and/or play structure. See, for example, U.S. Pat. No. 5,853,332 to Briggs, incorporated herein by reference. A wide variety of commercially available play toys and games are also known for providing valuable learning and entertainment opportunities for children, such as role playing, reading, memory stimulation, tactile coordination and the like.

However, there is always a demand for ever more exciting and entertaining games and toys, particularly those that increase the learning and entertainment opportunities for children and stimulate creativity and imagination.

SUMMARY OF THE INVENTION

The invention provides a unique gaming system and method of game play wherein gaming is carried out within a themed physical play space comprising an existing or specially configured entertainment facility or play structure. The game utilizes a plurality of themed play objects, preferably electronically identifiable objects, such as colored balls, shaped objects, cards, bands, RFID-tagged objects and/or the like, to provide an interactive game play experience generally simulative of a computer adventure game experience, but within a physical play space and incorporating both physical and mental challenges. Participants are preferably challenged, either working individually or cooperating with other play participants, to find identified objects, clues and/or other information and/or to use the objects, clues or other information to solve various puzzles or problems that present encumbrances inhibiting players from advancing in the game. Preferably, each play participant also possesses a unique RFID band, card or the like, that electronically identifies the play participant and enables the play system to award and track points or other rewards to successful play participants individually or working with other play participants as a team. Optionally, facial recognition, fingerprint identification and/or other biometric techniques and the like may be utilized to provide the desired player identification and/or tracking capability. Thus, play participants participate in a computer-orchestrated adventure game, but within a physical play space and utilizing their skills and play objects to overcome both physical and mental challenges presented by the game.

In accordance with one embodiment the present invention provides a method and system of interactive game play. The game includes a plurality of preferably distinguishable play objects and one or more consoles or stations adapted to distinguish and/or otherwise differentiate between the play objects. The game challenges play participants to find and use identified objects in identified consoles.

In accordance with another embodiment the present invention provides a method of game play wherein play participants participate in a computer driven adventure game, but using physical play space and physical play objects capable of interacting electronically with the computer driven gaming system.

In accordance with another embodiment the present invention provides a modified computer game carried out by one or more play participants within a themed play space using a computer interface comprising wireless ID tags worn by play participants and electronically identifiable play objects.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

Having thus summarized the general nature of the invention and its essential features and advantages, certain preferred embodiments and modifications thereof will become apparent to those skilled in the art from the detailed description herein having reference to the figures that follow, of which.

DETAILED DESCRIPTION OF THE PREFERRED EMBODIMENTS

Basic System and Framework

Figure 1:
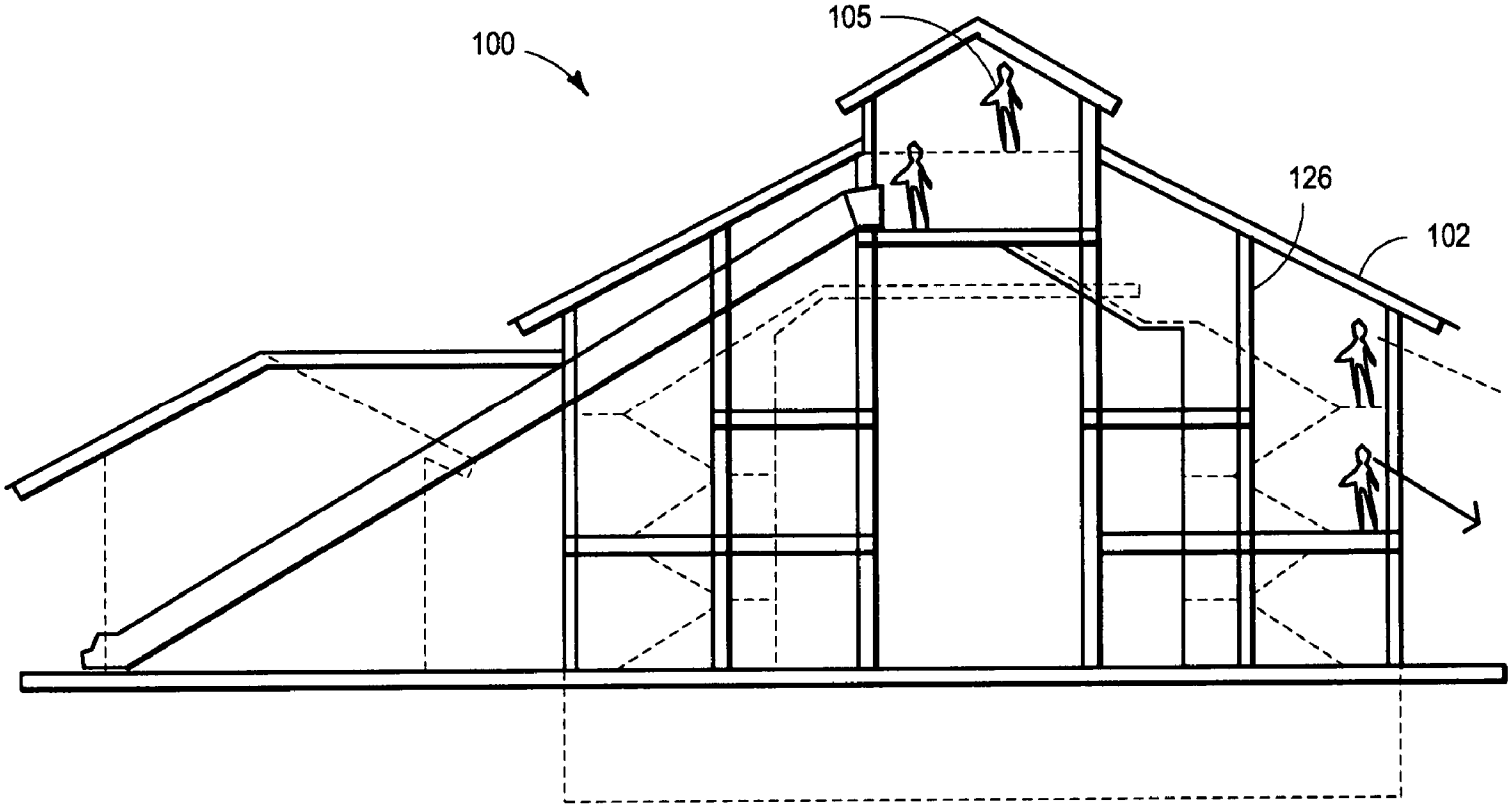
FIG. 1 is an elevation view of a play structure generally simulating a barn and being adapted and configured to carry out an interactive quest game in accordance with the present invention.

FIGS. 1-2 illustrate one preferred embodiment of an interactive play structure 100 configured and adapted to facilitate an interactive quest game having features and advantages in accordance with the present invention. The particular play structure illustrated takes on the theme of a "great barn" having multiple play levels, rooms, lofts and various themed harvesting equipment, machines, and various connecting/transport structures such as slides, chutes, climbing nets, and/or other themed play devices or props to be enjoyed by multiple play participants 105. Within this play structure 100, play participants 105 embark on a quest or mission to find and use various objects, tools or other provisions that are needed to solve problems, puzzles or challenges presented by the game. Puzzles or challenges within the context of the game may include, for example, fixing and/or operating various machinery, feeding objects into collection bins or sorting bins, timed mazes or obstacle courses and the like. These may or may not be timed puzzles/challenges, depending upon the game context and the degree of difficulty desired. Preferably, play objects, games and challenges are themed in accordance with the game. For example, any physical play objects are preferably distinguishable using either mechanical (e.g., size and/or shape discrimination), electrical (e.g. color sensing or RFID tagging), or other differentiating means (e.g., weighing, probing, touching, magnets, etc.). Alternatively, some or all of the play objects, tools or other provisions collected and used by play participants within the context of the game may be representative only. That is, such objects, tools, or provisions may have only a graphical, representative or conceptual existence within the game context and wherein their possession and use may be tracked within an associated game data base, for example.

Preferably, each play participant 105 and/or group of participants is uniquely identified via an RFID tag, card, bracelet and/or the like. Alternatively, facial recognition, fingerprint identification and/or other biometric techniques and the like may be utilized to provide desired player identification and/or tracking capability. Preferably, as each play participant moves throughout the play structure 100 and interacts with the various interactive devices, challenges, play effects and the like ("play elements") comprising the quest game, the quest play system is able to track and identify relevant attributes of play participants, such as points accumulated, levels achieved, special skills acquired, etc. Play participants advance in the game by successfully completing various challenges or puzzles presented throughout the play structure and/or throughout the course of game play.

Game play may either be timed (e.g. play participants pay for a certain period of play time) or it may be provided as unlimited play. Alternatively, play participants may be required to purchase a basic character to initiate the game. Then, as the play participant achieves various levels within the game and/or earns a certain amount of points, etc., the play participant is offered a special or limited opportunity to purchase additional "earned" objects such as special character powers or skills, tools, provisions, etc., that may assist the play participant advance in the game and/or increase enjoyment of the game. Once earned, these objects (real or representative) may be distributed or sold, for example, using a conventional retail distribution, vending machines, internet purchase processing and/or the like. Optionally, character images may be created and represented graphically on a display screen and/or printed on a collectible card or the like. As additional acquired quest objects are acquired, these may be printed or layered onto the image and/or a new image or card may be created based on the updated character information.

The play structure 100 itself preferably comprises a multi-level, modular play structure constructed using any one of an number of materials and construction techniques well known to those skilled in the art. The structure 100 may be suitable for either outdoor or indoor use, as desired. Preferably, the structure 100 comprises a supporting framework 102 formed from a plurality of interconnected support members 126, comprising columns, pylons, beams, connectors and the like. The support members 126 may be formed from any combination of convenient materials having sufficient strength and durability for safely supporting multiple play participants 105. For example, plastic or PVC pipes, steel pipes, I-beams or channel beams, reinforced concrete beams/columns, and the like may all be used to form the supporting framework 102.

For visual appeal and added safety, optional decorative panels, railings and/or roofing elements may be provided, as desired, to shade play participants 105 from the sun (for outdoor play structures), to prevent play participants from falling off the structure 100, or to complement a particular desired theme of the play structure 100. Decorative panels may be formed of wood, fiberglass or other reinforced fiber, PVC, aluminum, steel or a variety of other suitable materials, as desired. Corrosion-resistant materials are preferred, particularly if the play structure 100 is to be used outdoors. Of course, those skilled in the art will readily appreciate that a wide variety of other decorative or thematic elements may be incorporated into the overall design of the play structure 100 in order to provide added safety and/or to help convey a particular desired play theme.

Preferably (although not necessary to carry out the invention), a suitable play media, such as foam or rubber balls or similar objects (described later), is provided for use throughout the structure to provide a tactile interactive play experience. If desired, a number of conduits or other transport means may be provided throughout the framework 102 for transporting play media to and from the various play areas in the play structure 100. The conduits may be formed from plastic hosing or PVC pipes joined together using commercially available fittings, as is well known in the art. Conduits may also be formed from a wide variety of other suitable materials such as steel pipe, ceramic/clay pipe, or they may be formed as open channels and/or runners, as desired. Clear or colored/transparent plastic pipes having an inner diameter of about 2⅛"-6½", and more preferably about 3-4", are particularly preferred for aesthetic appeal and added excitement. Alternatively, larger or smaller diameter conduits or conduits having different colors or shapes may be used, as desired, to accommodate various sizes and shapes of balls or other play media. Play media may be conveniently transported by use of pressurized air or other suitable means, as desired. Various participant-operated or game-actuated conveyors or other machinery may also be employed to sort, process, transform, distributed or circulate balls or other play media from one area of the structure 100 to another, as desired.

The particular play structure shown in FIGS. 1-2 utilizes thousands of soft foam balls and molded plastic fruits and vegetables as an interactive play medium. These may be manipulated by play participants using various interactive play elements to create desired effects. Balls, fruits and vegetables may range in size from approximately 1" to 12" in diameter or larger, as desired, and are preferable about 2½" in diameter. Preferably, the balls are not so small as to present a choking hazard for young children. The majority of the balls may be the same size, or a mixture of ball sizes may be utilized, as desired. A few play elements, as described below, may utilize balls and/or fruits/vegetables of a relatively large diameter (about 12" or more). Certain play elements may use only certain sized balls, with filtering relays (not shown) in the conduits permitting only certain sized balls to roll to certain play areas. A range of colors for the balls may also be used for visual and thematic appeal. Optionally, ball sizes and/or types may be color-coded and/or electronically tagged using integrated internal or external RFID tags/transponders (described later), as desired, to indicate their particular identity, type or compatibility with particular play elements, play participants, certain play zones and/or for facilitating their return to the proper areas when they are removed.

Other suitable play media may include, without limitation, foam, plastic or rubber balls and similarly formed articles such as cubes, plates, discs, tubes, cones, rubber or foam bullets/arrows, the present invention not being limited to any particular preferred play media. These may be used alone or in combination with one another. For instance, flying discs, such as Frisbees™, may be flung from one location on the play structure 100 while other play participants shoot at the discs using foam balls or suction-cup arrows. Wet or semi-wet play mediums, such as slime-like materials, snow, mud, squirt guns and/or water balloons may also used, as desired, to cool and entertain play participants. Durable plastic or rubber play media are preferable in an outdoor play structure where environmental exposure may prematurely destroy or degrade the quality of certain play mediums such as foam balls. The particular play media used is not particularly important for purposes of carrying out the invention and, optionally, may be omitted altogether, if desired. As noted above, the invention may also be carried out without using any play media at all and/or by using entirely or in part representative play media that is tracked on an associated game data-base or the like.

Figure 2A:
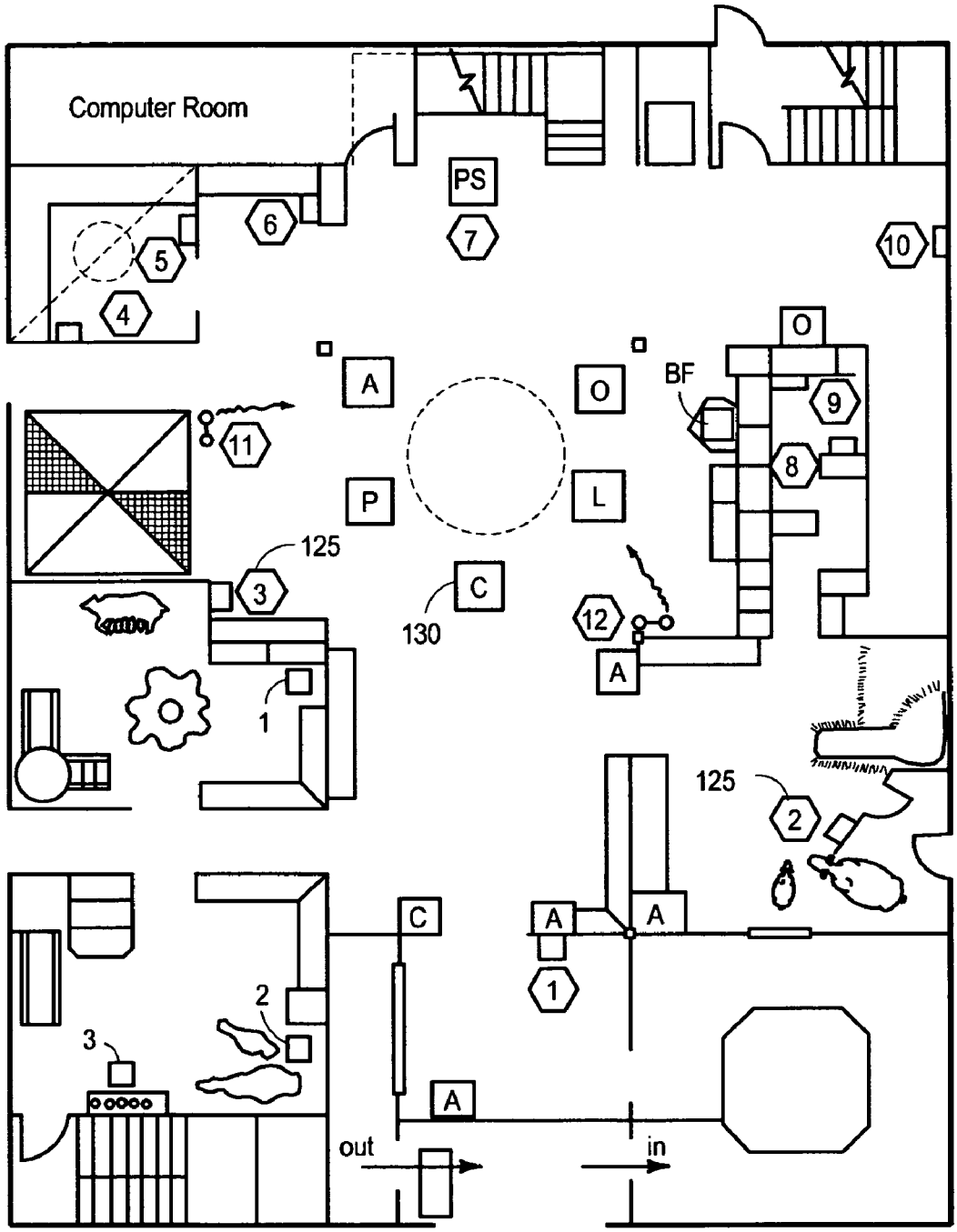
FIGS. 2A-D are top plan views of various identified levels of the interactive play structure of FIG. 1 having features and advantages in accordance with the present invention.
Figure 2B:
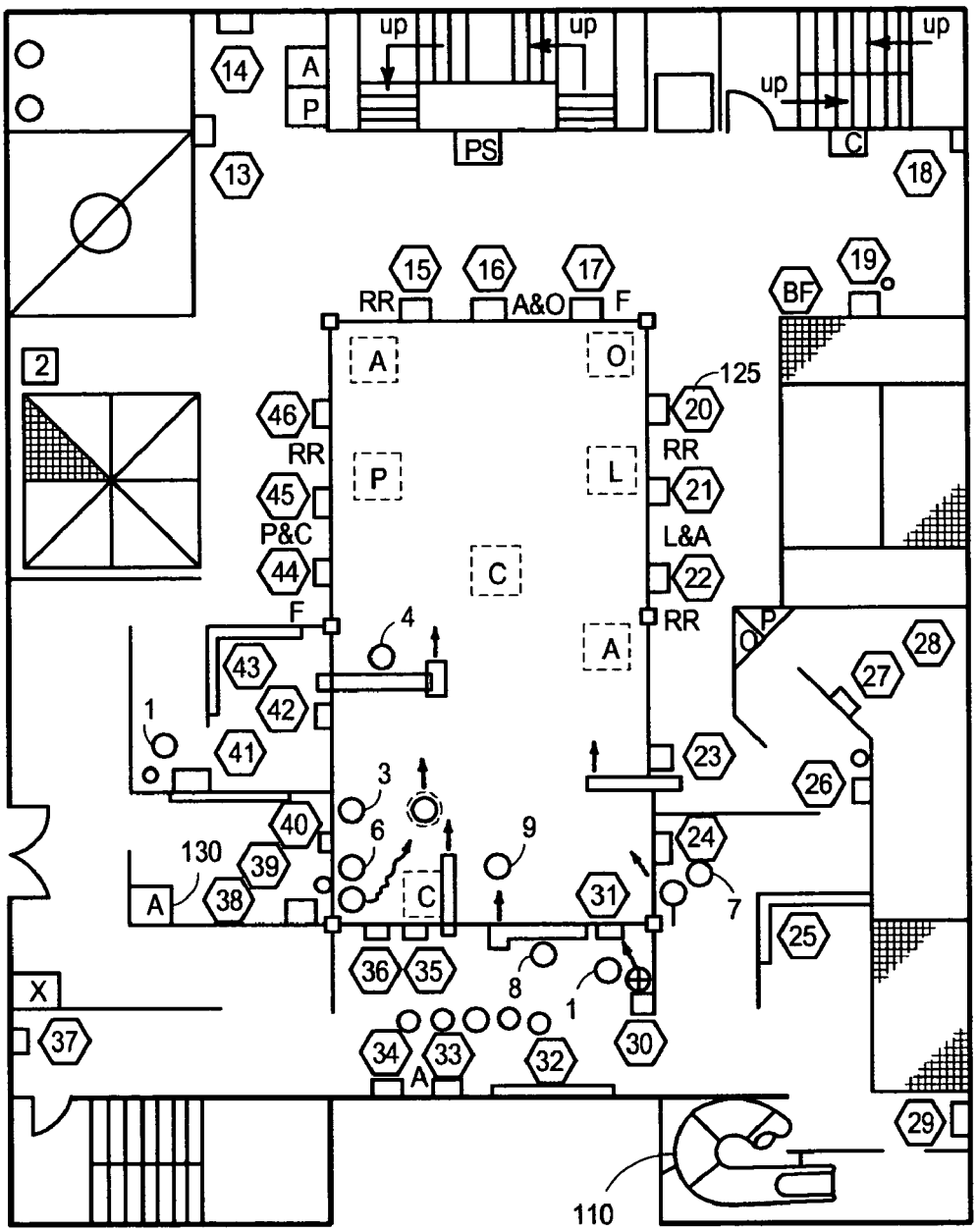
Figure 2C:
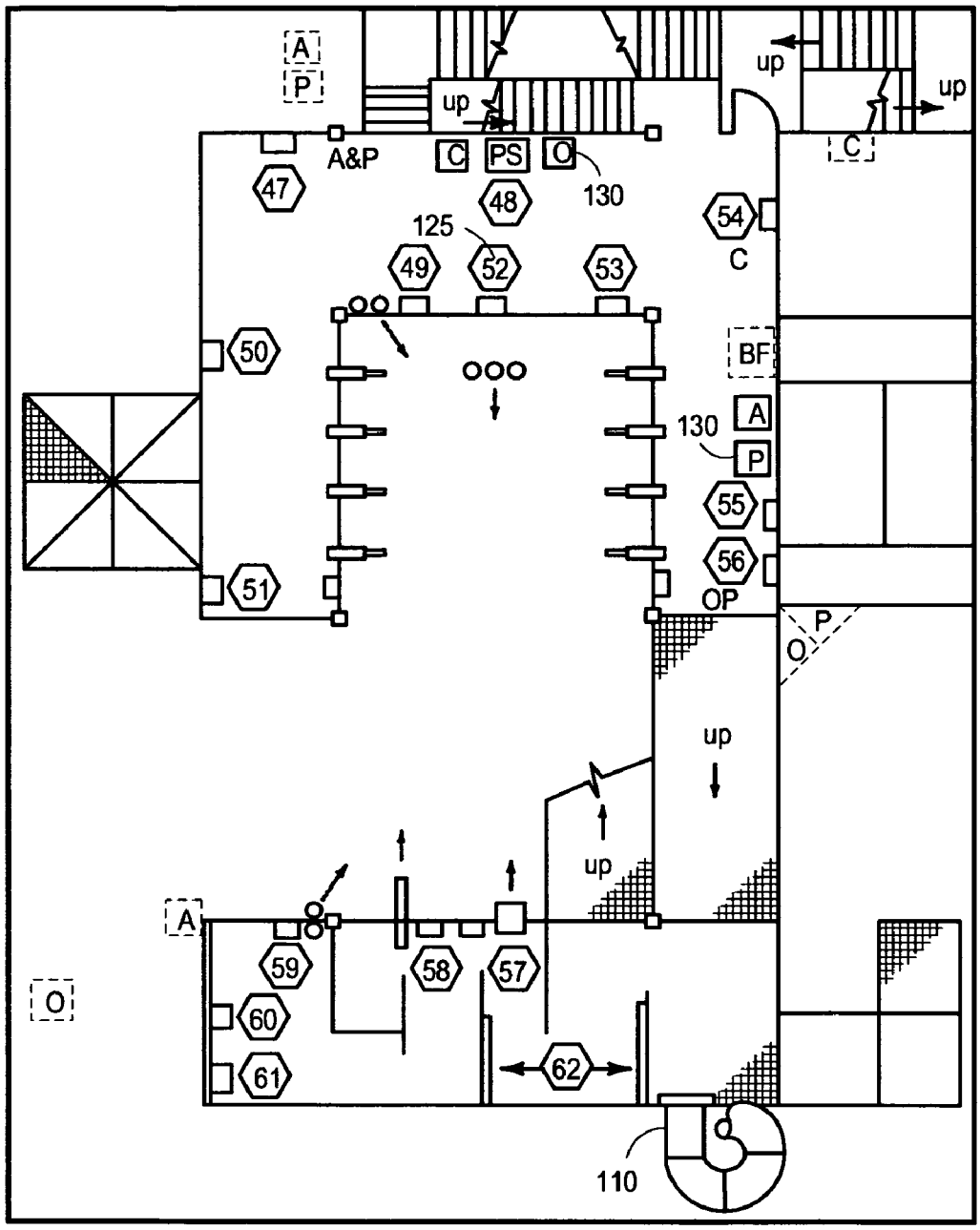
Figure 2D:
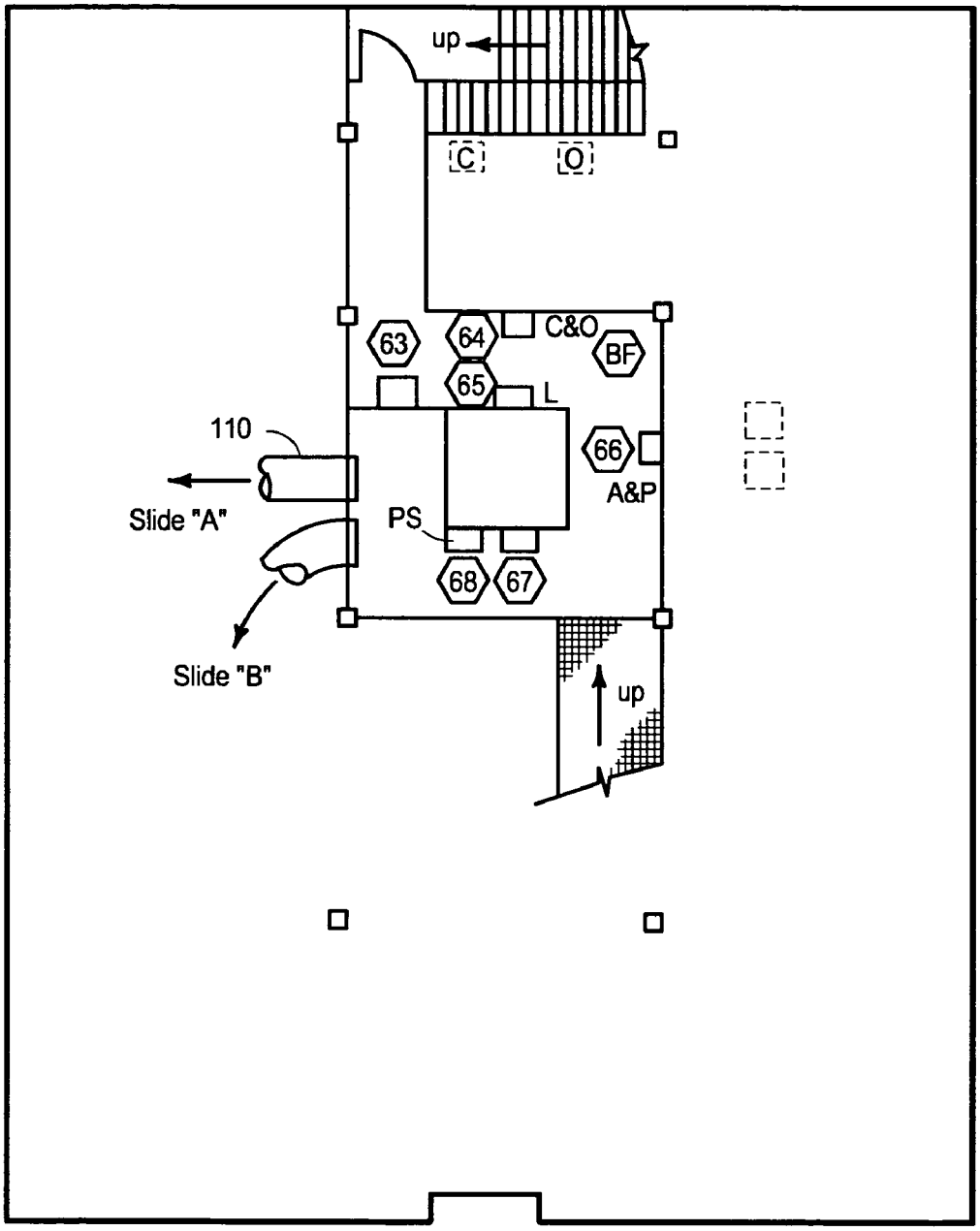

The play structure 100 also preferably incorporates a number of other conventional (passive or active) play elements, such as climbing nets, crawl tunnels, swinging bridges, slides 110, and the like as shown in FIGS. 2B-D. These provide entertaining physical challenges between play areas and/or between play elements and allow play participants to safely negotiate their way in a fun and entertaining manner through the various areas of the play structure 100. Slides 110 may also be provided at the front, rear, and/or sides of the play structure 100 and may be straight, curved, or spiral-shaped, as desired. They may also be enclosed and tube-like or open and exposed to flying play media, as desired. Alternatively, those skilled in the art will readily appreciate that the size, number, and location of the various slides 110 can be varied, as desired, while still enjoying the benefits and advantages of the present invention. In a particularly preferred embodiment, one or more special slides may provided as rewards or incentives for game participants who have attained a certain level within the game context or earned a certain amount of points in the game. Access to these special slides may be controlled electronically, e.g. by a water-fall or sheet of water flow that can be selectively shut on or off via a solenoid valve or the like or by a selectively releasable magnetic latching mechanism or the like. Alternatively, a human operator may control access to the special slides according to whatever game rules and entry requirements are selected.

Multiple ball pits and the like may also be provided at various locations throughout the play structure. Those skilled in the art will readily appreciate that a wide variety of other play elements, such as funny mirrors, rotating tunnels, trampolines, climbing bars, swings, etc. may all be used to create a desired play environment for carrying out or enhancing the features and advantages as of the present invention as taught herein.

While a particular preferred play environment and play structure 100 has been described, it will be readily apparent to those skilled in the art that a wide variety of other possible play environments, play structures, entertainment centers and the like may be used to create an interactive play environment within which the invention may be carried out. For instance, a suitable play structure may be constructed substantially entirely of molded or contoured concrete, fiberglass or plastic, as desired. Alternatively, a suitable play structure may be constructed entirely or partially from conduits or pipes which also transport play media to and from various locations throughout the play structure. Alternatively, the play environment need not comprise a play structure at all, but may be simply a themed play area, or even a multi-purpose area such as a restaurant dining facility, family room, bedroom or the like.

FIGS. 2A-D are top plan views of various identified levels of the interactive play structure of FIG. 1. As illustrated and described in more detail in Appendix "A" a plurality of interactive quest consoles 125, 130 are distributed throughout the structure 100. Some or all of these consoles are adapted to electronically identify certain play objects ("quest objects") presented and/or tasks completed by play participants 105. If the quest object presented or task completed is "correct" for that console, then the quest game advances to the next level and/or the participant is awarded certain points, special skills, and/or other forms of reward. If the quest object presented or task completed is "incorrect," then no points are awarded and the console preferably instructs the play participant 105 how to successfully complete the quest challenge for that console.

Slides 110 (and/or other "ride" type attractions) are preferably arranged at one or more levels (e.g., 27' level as shown in FIG. 2D) and preferably may be accessed by play participants only after the quest game (or a defined portion thereof is completed and/or when the play participant 105 (or team of play participants working together) accumulates a predetermined number of points. As noted above, preferably, an electronic gate or an operator at the entry of the slide controls access to the slides or other attraction.

Quest Consoles

In the preferred embodiment illustrated, multiple interactive quest consoles 125, 130 are arranged throughout the structure 100 and are adapted to receive various inputs, such as pushing a button, turning a crank, pulling a lever, releasing a plunger, or inserting various quest objects. Consoles may be as simple as a "you-found-me" box (e.g., simple reader or reader/writer that communicates with a presented RFID tag), inserting an object or selecting a button representing the correct answer to a question, riddle or puzzle or as complex as a fully integrated computer-animated gaming system into which play participants are able to "insert" themselves or their selected characters to play a computer/video game and/or portion thereof to attain a desired goal or result.

Preferably, a wide variety of fun and entertaining console inputs are provided throughout the game system so as to provide excitement and variety of play experience throughout. Preferred examples include, without limitation: speed of reaction time tests, repeat the light/sound pattern, remember the hidden objects (e.g., concentration games), recognize a song (e.g., "name that tune" games), recognize a famous face or voice, peddle a bicycle, peddle a fan, jump as high as you can, jump as far as you can, fly an airplane, row a boat, ride a simulated jet ski or motorcycle, drive a simulated race car, climb a rock wall, walk a tight-rope or balance beam, play a musical instrument, send a secret encrypted message (e.g., using. Morse code), decode a secret encrypted message, control a simulated skate or surf board, match the dance steps, spell a word, name the state or country, Twister™ game, Operation™ game, Battleship™ game, tick-tack-toe, find and push the lighted buttons as fast as you can (e.g. variations of "Whack-a-mole™" game), operate a crane and/or robot claw, complete the hop-scotch steps, basket toss, bean bag toss, tug-of-war, skip a rope, hammer a peg or nail, turn a wrench, thread a nut on a bolt, turn a gear, follow the recipe, build a machine using certain parts to solve a required task (e.g., "Rube-Goldberg" challenge), or play a computer/video simulation or game.

Quest objects may be physical objects found in the play space such as foam balls or the like, or they may be conceptual or representative objects, such as virtual objects, tools or provisions, as noted previously. Quest objects may also comprise clues or information that play participants use in solving various puzzles or challenges. If physical objects are used, preferably these may comprise foam balls provided in assorted colors and/or provided in a consistent theme such as fruits and vegetables. For example, in the illustrated game system 100 play participants 105 collect the balls and/or other quest objects and/or clues distributed throughout the structure and then use them at the correct console to receive points.

FIGS. 3A-3I are partial schematic views of various preferred embodiments of interactive quest game consoles having features and advantages in accordance with the present invention. In each case, the play participant preferably first presents his or her identifying card, key and or bracelet or other identifying features to a reader, which uniquely identifies the play participant and tracks and/or records his or here experience electronically.

Figure 3A:
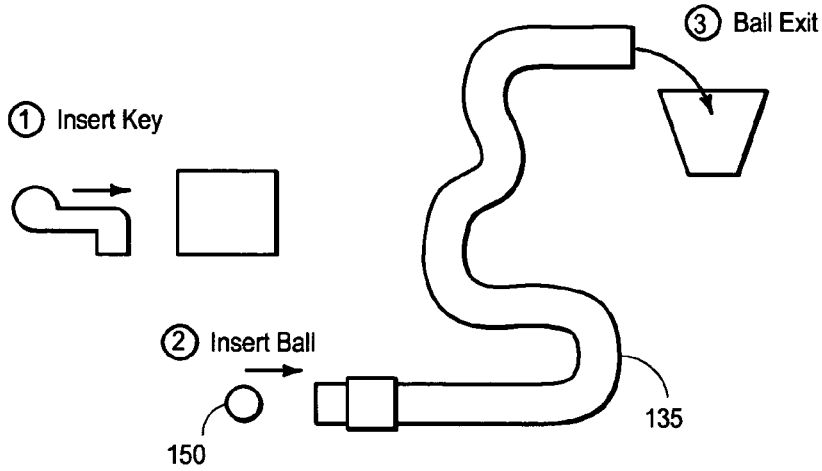
FIGS. 3A-I are partial schematic views of various preferred embodiments of interactive quest game consoles having features and advantages in accordance with the present invention.

In FIG. 3A the play participant inserts a requested quest object(s) (e.g., balls 150) into a suction tube 135. The suction tube preferably deposits the balls 150 into a collection basket located on another level of the play structure 100. Optionally, a color sensor may be used to sense/identify the color of each ball 150 as it passes through tube 135. In that case the console would preferably be configured to only award points when the "correct" color ball is inserted by the play participant. Alternatively, each ball or other quest object may contain other electronically identifiable indicia such as an RFID tag, transponder or the like (described later) which may similarly be used to electronically identify quest objects.

Figure 3B:
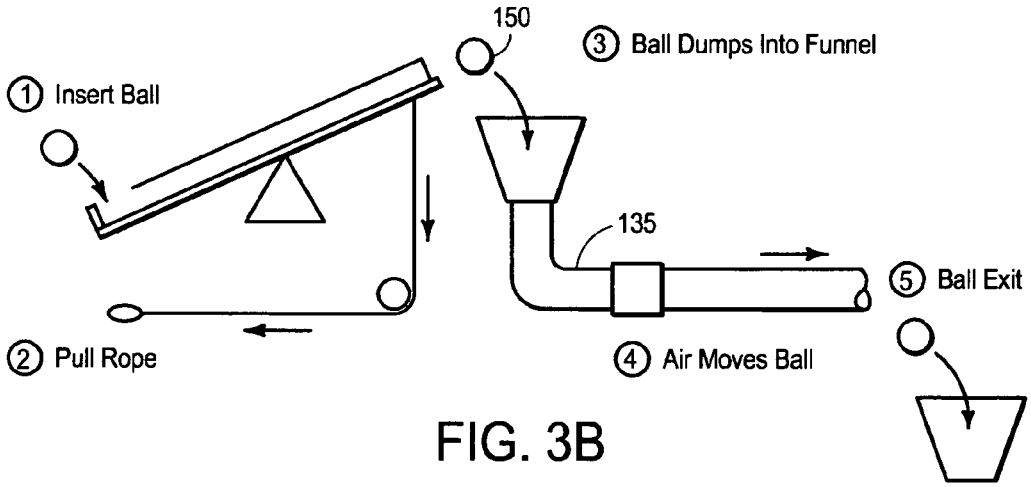

In FIG. 3B the play participant places a requested quest object(s) (e.g., balls 150) on a chute in a particular number and/or order. The chute is configured to dump the balls 150 into the inlet of a pneumatic ball-handling system which preferably transports the balls 150 to a collection basket located on another level of the play structure 100. Optionally, a color sensor may be used to sense/identify the color of each ball 150 as it passes through tube 135. In that case the console would preferably be configured to only award points when the "correct" color ball is inserted by the play participant. Alternatively, each ball or other quest object may contain other electronically identifiable indicia such as an RFID tag, transponder or the like (described later) which may similarly be used to electronically identify quest objects.

Figure 3C:
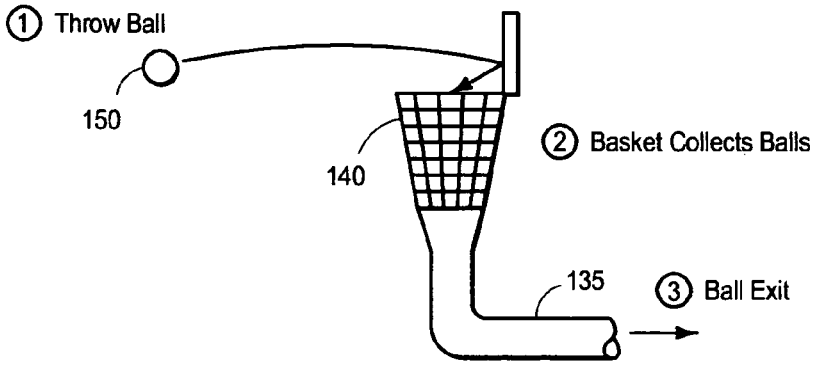

In FIG. 3C the play participant throws a requested quest object(s) (e.g., ball 150) into a target basket 140. The target basket 140 funnels the balls 150 into the inlet of a pneumatic ball-handling system which preferably transports the balls 150 to a collection basket located on another level of the play structure 100. Optionally, a color sensor may be used to sense/identify the color of each ball 150 as it passes through tube 135. In that case the console would preferably be configured to only award points when the "correct" color ball is inserted by the play participant. Alternatively, each ball or other quest object may contain other electronically identifiable indicia such as an RFID tag, transponder or the like (described later) which may similarly be used to electronically identify quest objects. If desired, the target basket may be a timed challenge such that, for example, the play participant has 30 seconds to throw as many balls as possible into the bin for points, or, alternatively, 30 second to throw in 5 balls successfully, or throw in 4 different color balls, etc. Alternately, bonus points may be awarded based on how fast the challenge is completed and/or how well it is completed.

Figure 3D:
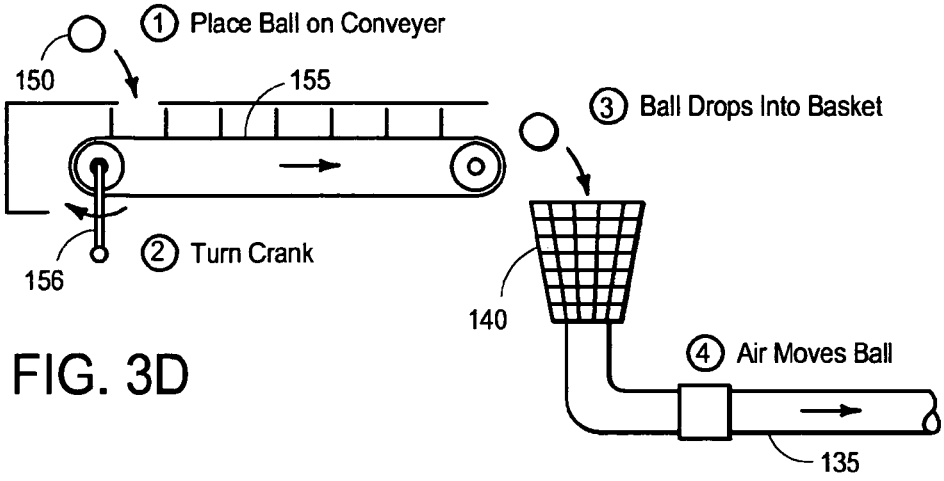

In FIG. 3D the play participant places the requested quest object(s) (e.g., balls 150) onto a conveyer 155 and then turn a crank handle 156 to move the balls into a target basket 140. The target basket 140 funnels the balls 150 into the inlet of a pneumatic ball-handling system which preferably transports the balls 150 to a collection basket located on another level of the play structure 100. Optionally, a color sensor may be used to sense/identify the color of each ball 150 as it passes through tube 135. In that case the console would preferably be configured to only award points when the "correct" color ball is inserted by the play participant. Alternatively, each ball or other quest object may contain other electronically identifiable indicia such as an RFID tag, transponder or the like (described later) which may similarly be used to electronically identify quest objects. Alternatively, quest objects may be conceptual or representative only such that the transportation, possession, and use thereof may be tracked using an associated database, a portable information storage device, information exchange platform, RFID tag, and/or the like.

Figure 3E:
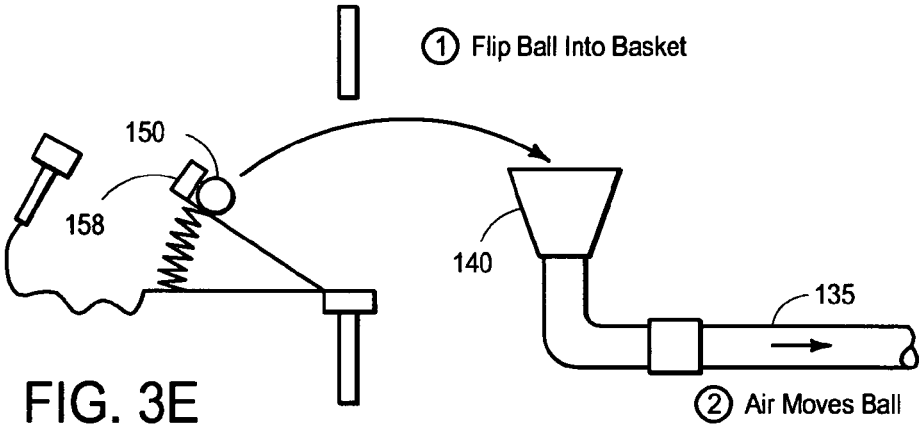

In FIG. 3E the play participant must place the requested quest object(s) (e.g., balls 150) onto a catapult 158 and then operate the catapult to shoot the balls into a target basket 140. The target basket 140 funnels the balls 150 into the inlet of a pneumatic ball-handling system which preferably transports the balls 150 to a collection basket located on another level of the play structure 100. Optionally, a color sensor may be used to sense/identify the color of each ball 150 as it passes through tube 135. In that case the console would preferably be configured to only award points when the "correct" color ball is inserted by the play participant. Alternatively, each ball or other quest object may contain other electronically identifiable indicia such as an RFID tag, transponder or the like (described later) which may similarly be used to electronically identify quest objects.

Figure 3F:
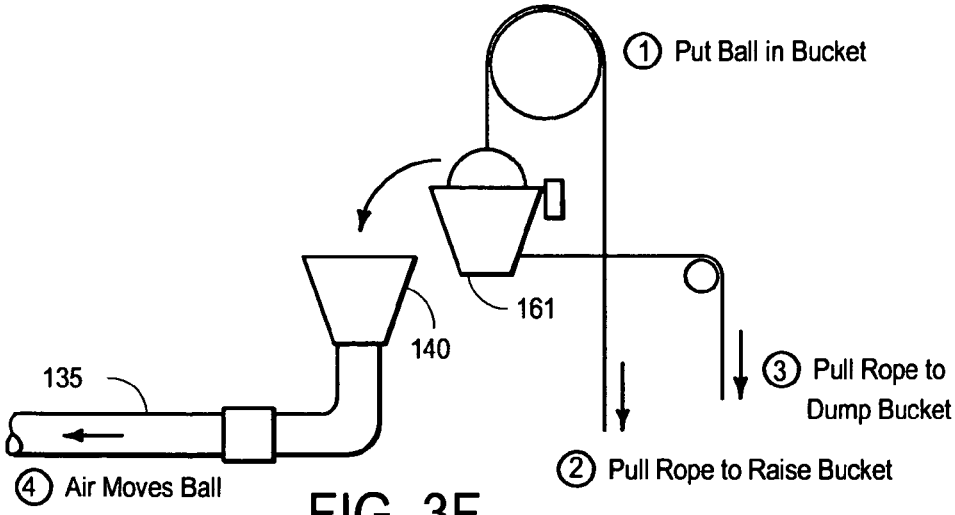

In FIG. 3F the play participant places the requested quest object(s) (e.g., balls 150) into a bucket 161 and then manipulate the bucket using various ropes in order to dump the balls into a target basket 140. The target basket 140 funnels the balls 150 into the inlet of a pneumatic ball-handling system which preferably transports the balls 150 to a collection basket located on another level of the play structure 100. Optionally, a color sensor may be used to sense/identify the color of each ball 150 as it passes through tube 135. In that case the console would preferably be configured to only award points when the "correct" color ball is inserted by the play participant. Alternatively, each ball or other quest object may contain other electronically identifiable indicia such as an RFID tag, transponder or the like (described later) which may similarly be used to electronically identify quest objects.

Figure 3G:
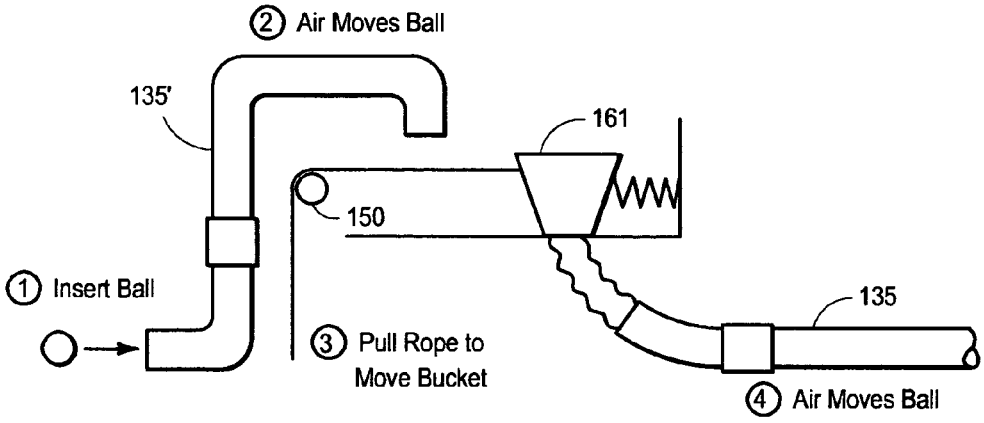

In FIG. 3G the play participant places the requested quest object(s) (e.g., balls 150) into a first suction tube 135' and then manipulate a bucket 161 using various ropes in order to receive the ball(s) and move them to the inlet of a second suction tube 135 which preferably transports the balls 150 to a collection basket located on another level of the play structure 100. Optionally, a color sensor may be used to sense/identify the color of each ball 150 as it passes through tube 135. In that case the console would preferably be configured to only award points when the "correct" color ball is inserted by the play participant. Alternatively, each ball or other quest object may contain other electronically identifiable indicia such as an RFID tag, transponder or the like (described later) which may similarly be used to electronically identify quest objects.

Figure 3H:
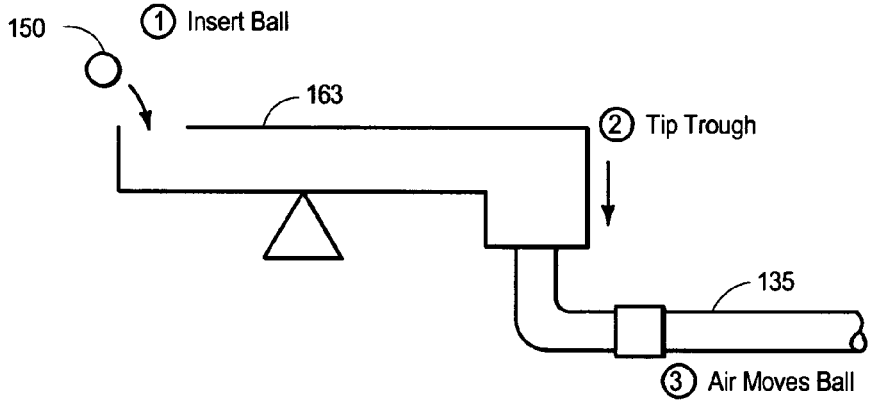

In FIG. 3H the play participant places the requested quest object(s) (e.g., balls 150) onto a tipping trough 163 and then tilt the trough to drain the balls into the inlet of a pneumatic ball-handling system which preferably transports the balls 150 to a collection basket located on another level of the play structure 100. Optionally, a color sensor may be used to sense/identify the color of each ball 150 as it passes through tube 135. In that case the console would preferably be configured to only award points when the "correct" color ball is inserted by the play participant. Alternatively, each ball or other quest object may contain other electronically identifiable indicia such as an RFID tag, transponder or the like (described later) which may similarly be used to electronically identify quest objects.

Figure 3I:
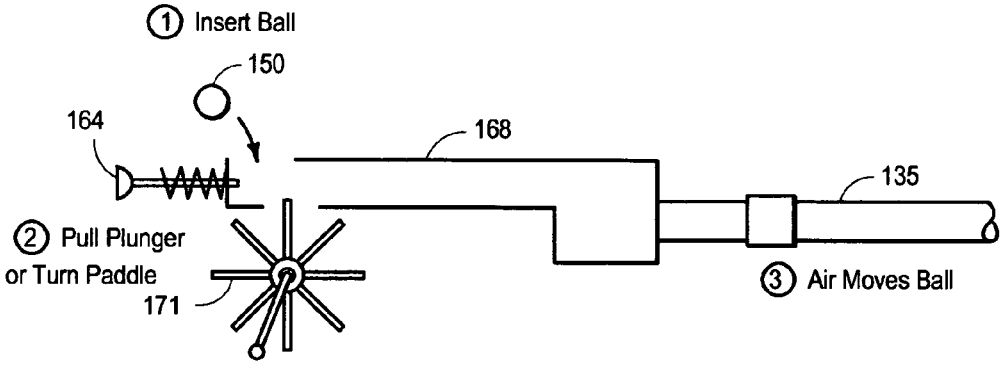

In FIG. 3I the play participant places the requested quest object(s) (e.g., balls 150) onto a trough 168 and then operate either a pinball-type plunger or paddle-wheel 171 to move the balls to the inlet of a pneumatic ball-handling system which preferably transports the balls 150 to a collection basket located on another level of the play structure 100. Optionally, a color sensor may be used to sense/identify the color of each ball 150 as it passes through tube 135. In that case the console would preferably be configured to only award points when the "correct" color ball is inserted by the play participant. Alternatively, each ball or other quest object may contain other electronically identifiable indicia such as an RFID tag, transponder or the like (described later) which may similarly be used to electronically identify quest objects.

FIGS. 4A-D are perspective views of various alternative preferred embodiments of interactive quest game consoles having features and advantages in accordance with the present invention. In each case, the play participant preferably first presents his or her identifying card, key and/or bracelet or other identifying features to a reader, which uniquely identifies the play participant and/or records his or her experience electronically. Such identification may require an overt action by the play participant (e.g. placing wrist-band next to a reader) and/or it may be accomplished automatically using, for example, long range RFID tags and readers, facial or biometrics recognition, voice recognition, and/or the like.

Figure 4A:
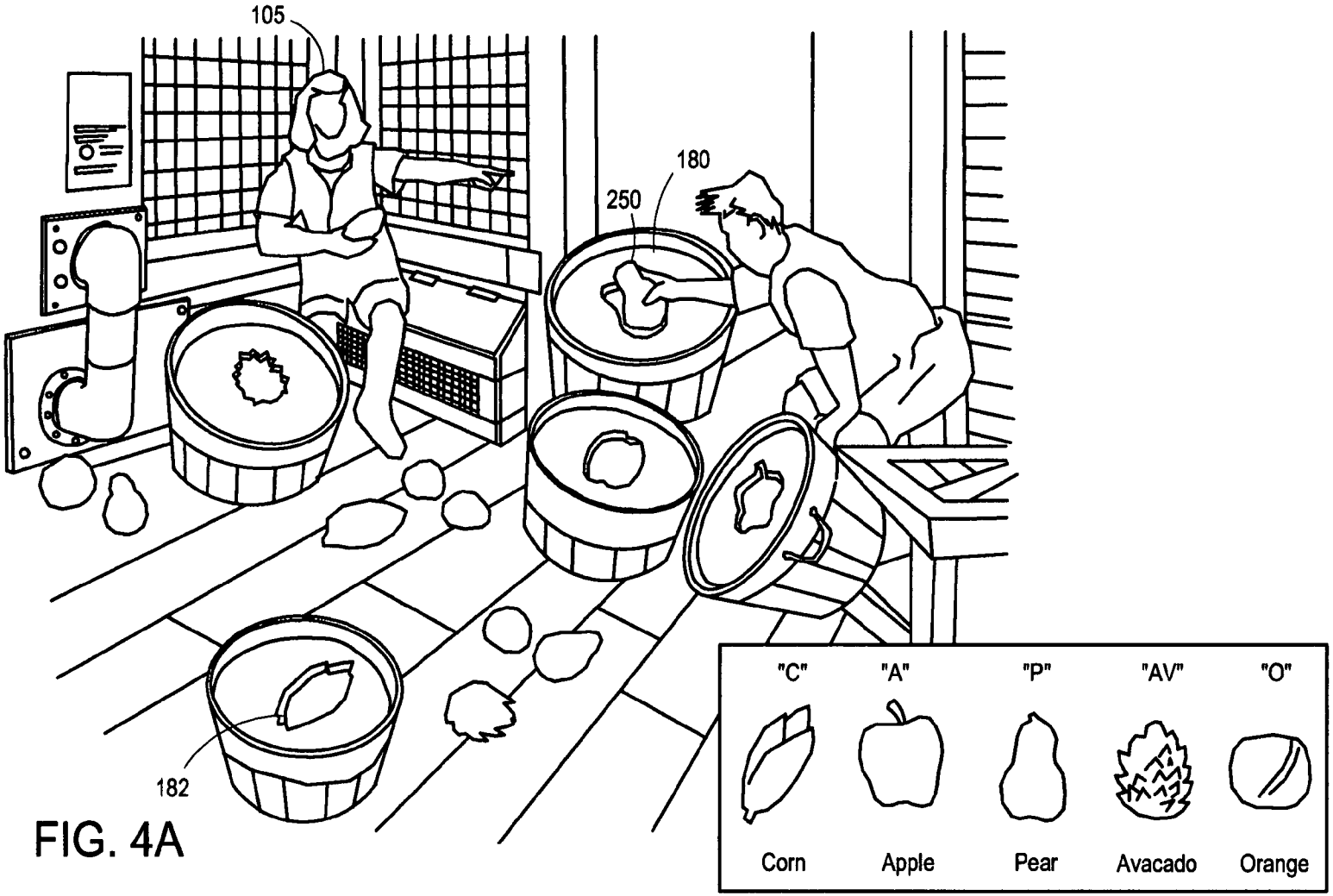
FIGS. 4A-D are perspective views of various additional preferred embodiments of interactive quest game consoles for use with play fruits and vegetables ("harvest theme") having features and advantages in accordance with the present invention.
Figure 4B:
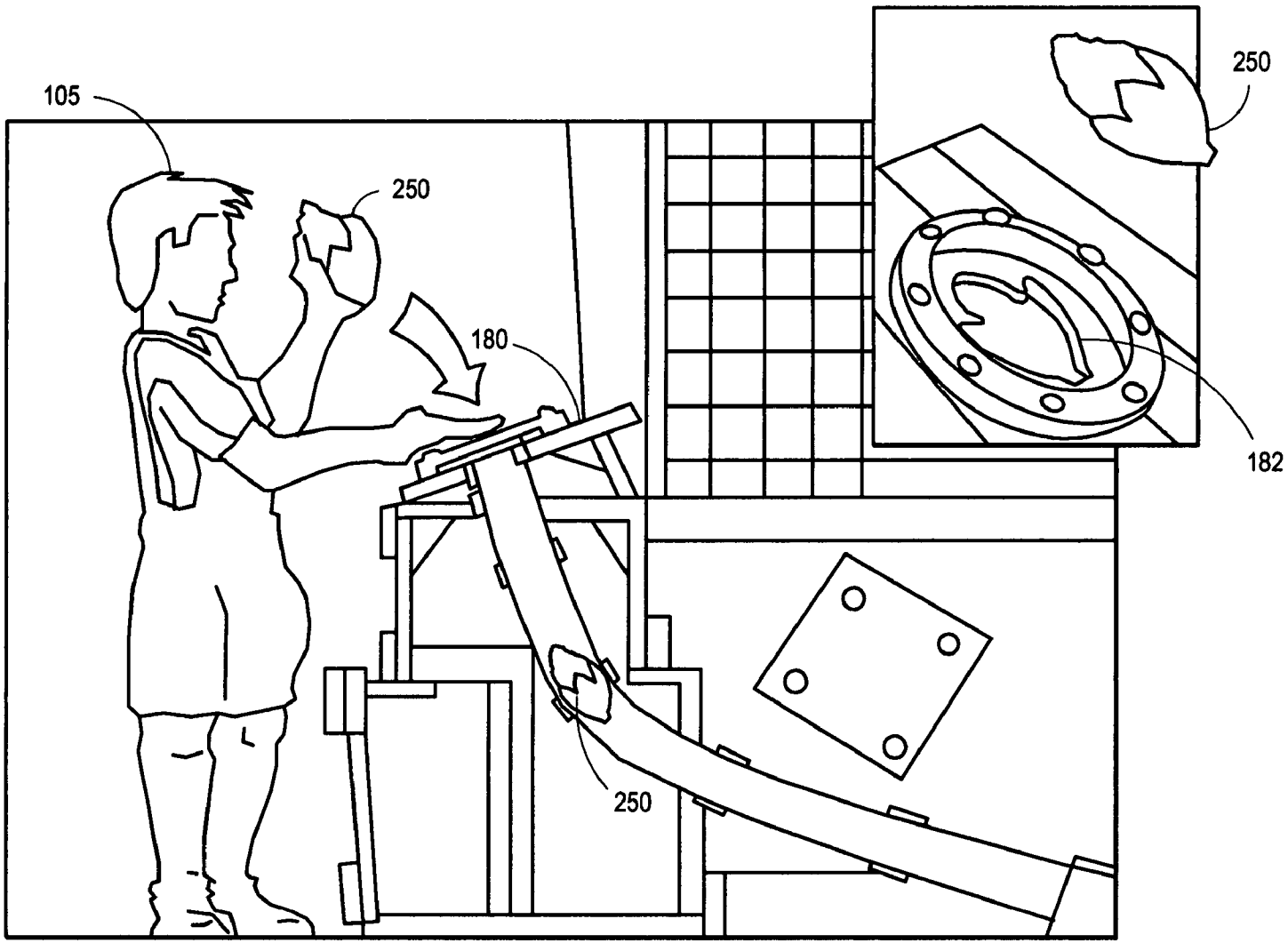

In FIGS. 4A-B, play participants insert quest objects in the form of molded plastic fruits and vegetables 250 into various openings 182 provided in quest receiving baskets 180 located throughout the play facility 100. The openings may be shaped or otherwise formed so as to provide mechanically discrimination of quest objects such that, for example, only certain sized or shaped quest objects may be inserted into the receiving basket Alternatively, each fruit and vegetable may includes an RFID tag, transponder and/or or other electronically identifiable indicia (described later) which may is used to track quest objects and award points to play participants. Each RFID tag contained in the associated quest object is preferably dynamically coded with a unique identification number of the play participant 105 (or team) who possesses it. For example, quest objects may be dispensed via a dispensing machine to individual play participants and simultaneously coded with that play participant's unique ID number. This ID number may also be contained on an RFID tag, token or other identifying device carried by the play participant or it may be stored on a centralized database.

Figure 4C:
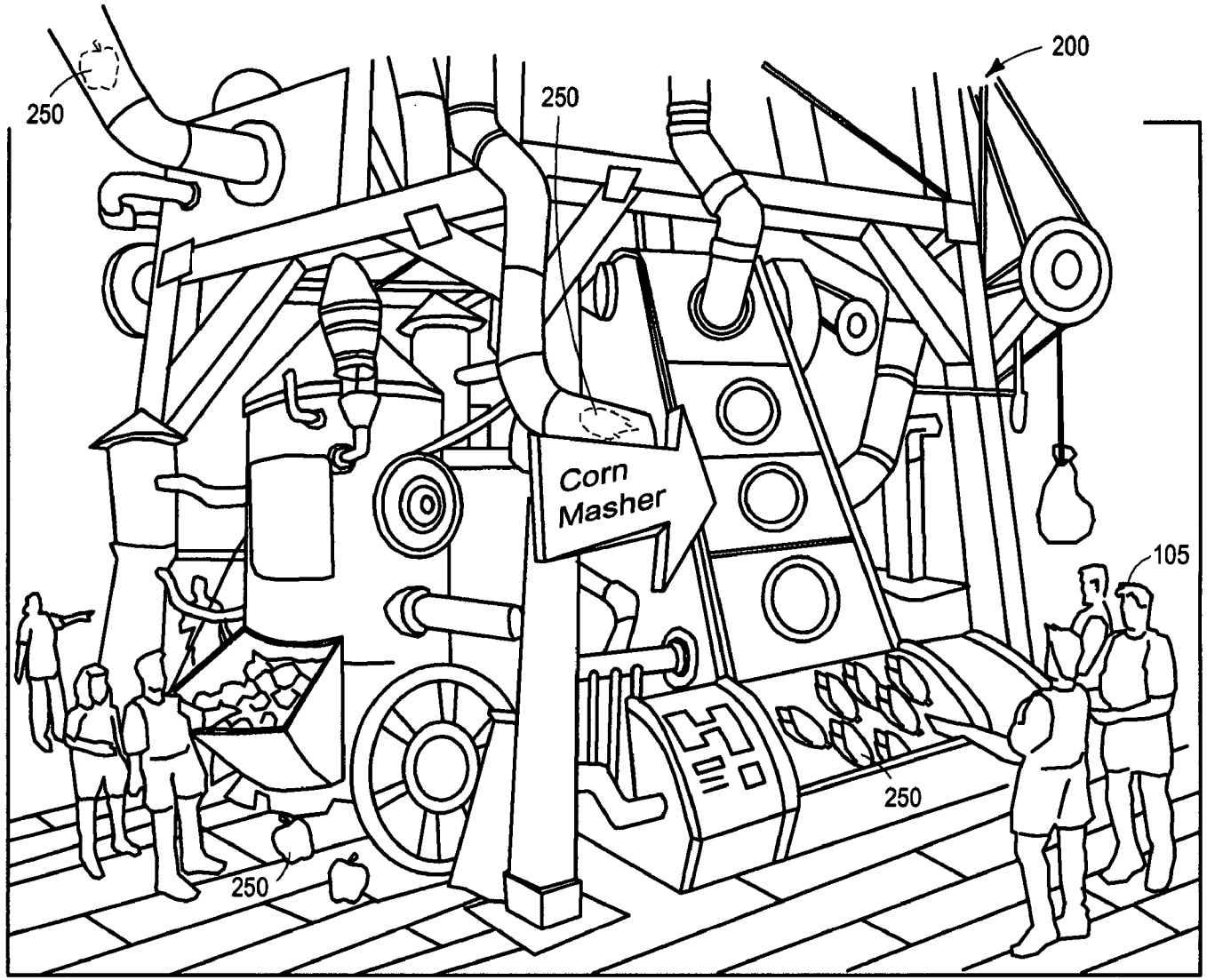

After the various fruits and vegetables are inserted into the baskets 180, they are preferably conveyed and deposited into a "great machine" 200, as illustrated in FIG. 4C. The great machine simulates a large harvesting/processing machine of the type one might find in a commercial harvesting factory, cannery, juicing factory and/or the like. Preferably, as the fruits and vegetables are transported through the machine they are passed over an RFID reader device, color sensor, and/or other one or more other quest object discriminators which identifies each fruit and accords points to play participants according, for example, a coded unique ID number stored on a tag in each fruit. Thus, play participants compete to gather and insert the most fruit into the various baskets which "feed" the great machine 200. Of course, this aspect of the invention is not limited to the particular themed application illustrated here. Alternatively, it may be configured and used in a wide variety of other applications, such as tracking and awarding points for target shooting, basket ball shooting, skeet ball, bean-bag toss, darts and a wide variety of other games involving movable game objects. Advantageously, by coding tagged game objects (e.g., foam balls ejected by a ball blaster) with a unique ID identifying the associated play participant, centralized point tracking and displaying of individual and/or team scores is easily facilitated. Alternatively, simpler and/or less expensive quest object identifiers and discriminators may be used either centrally or distributed throughout the quest play area. Alternatively, quest objects may be conceptual or representative only such that the transportation, possession, and use thereof may need only to be tracked using an associated database, a portable information storage device, information exchange platform, RFID tag, mag-strip card and/or the like.

Figure 4D:
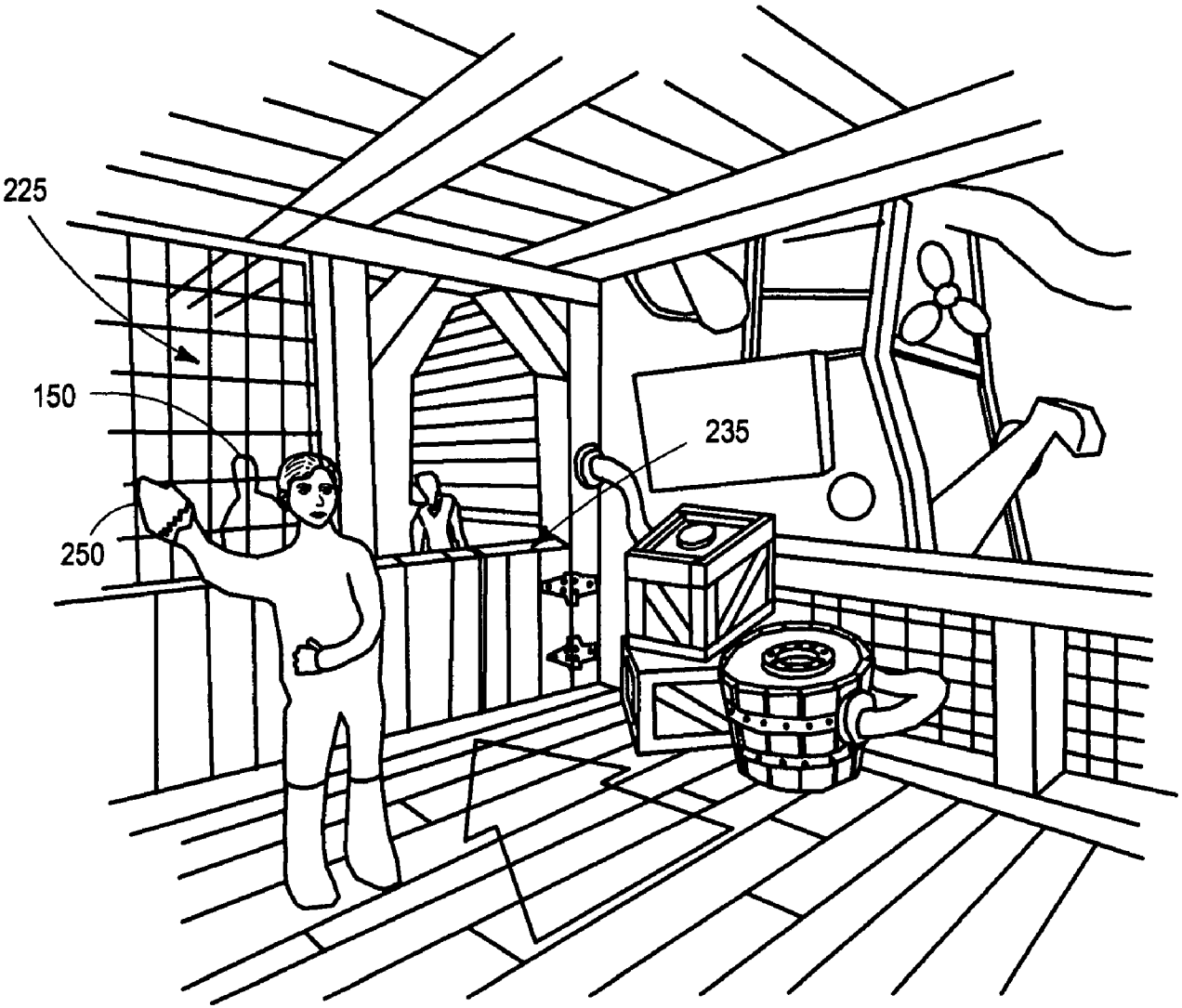
Figure 5A:
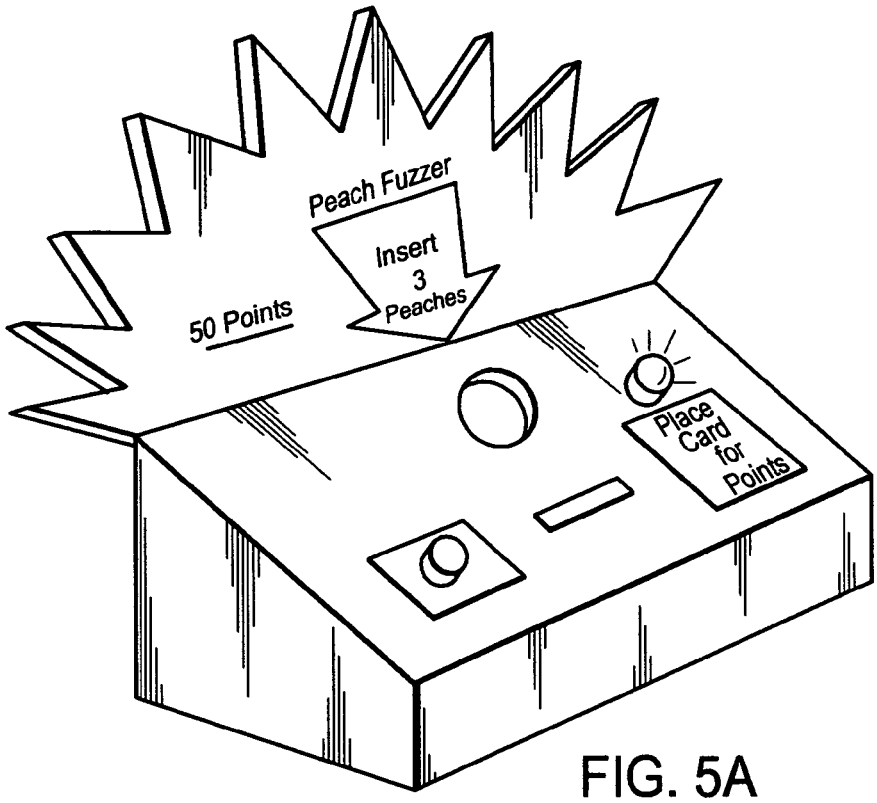
FIGS. 5A-F are perspective views of various additional preferred embodiments of interactive quest game consoles having features and advantages in accordance with the present invention.
Figure 5B:
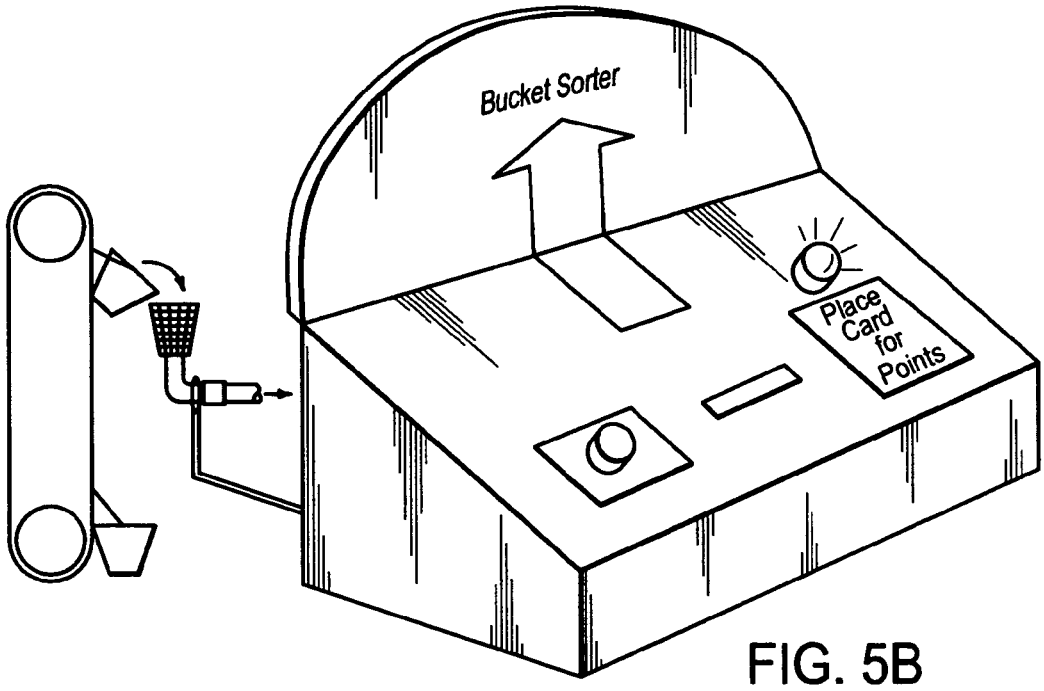
Figure 5C:
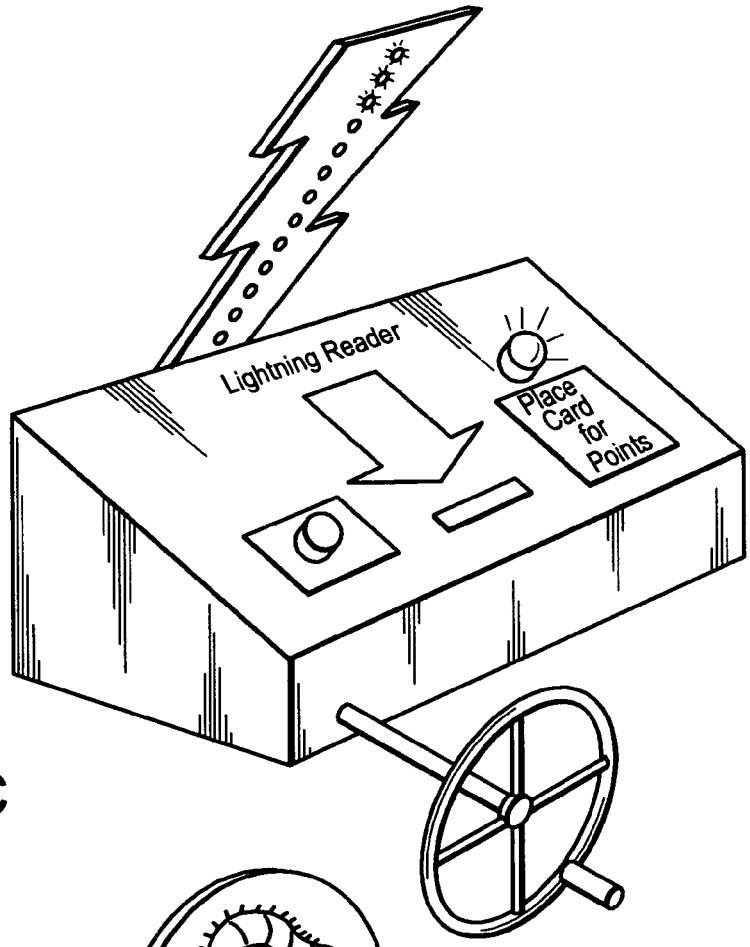
Figure 5D:
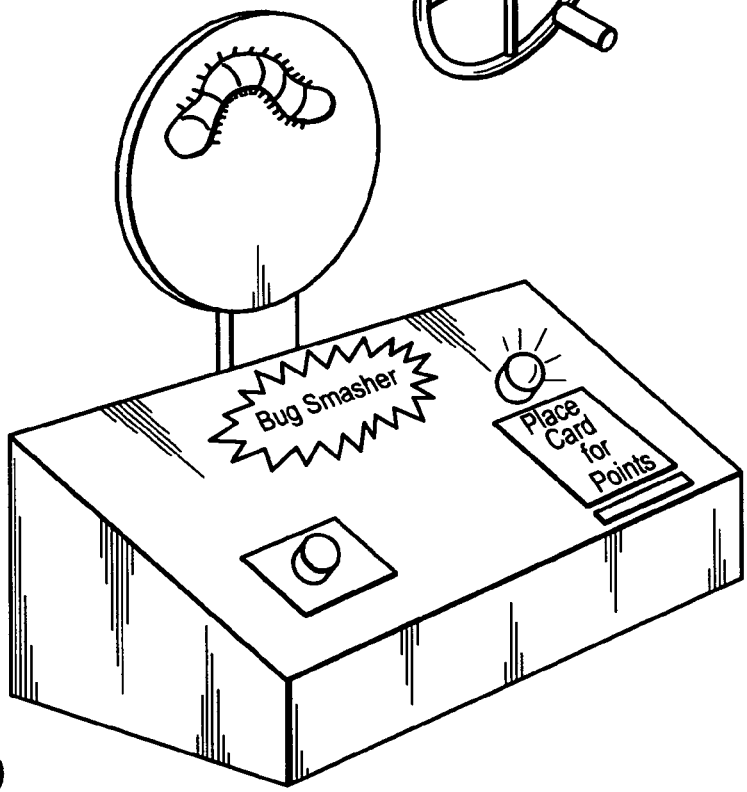
Figure 5E:
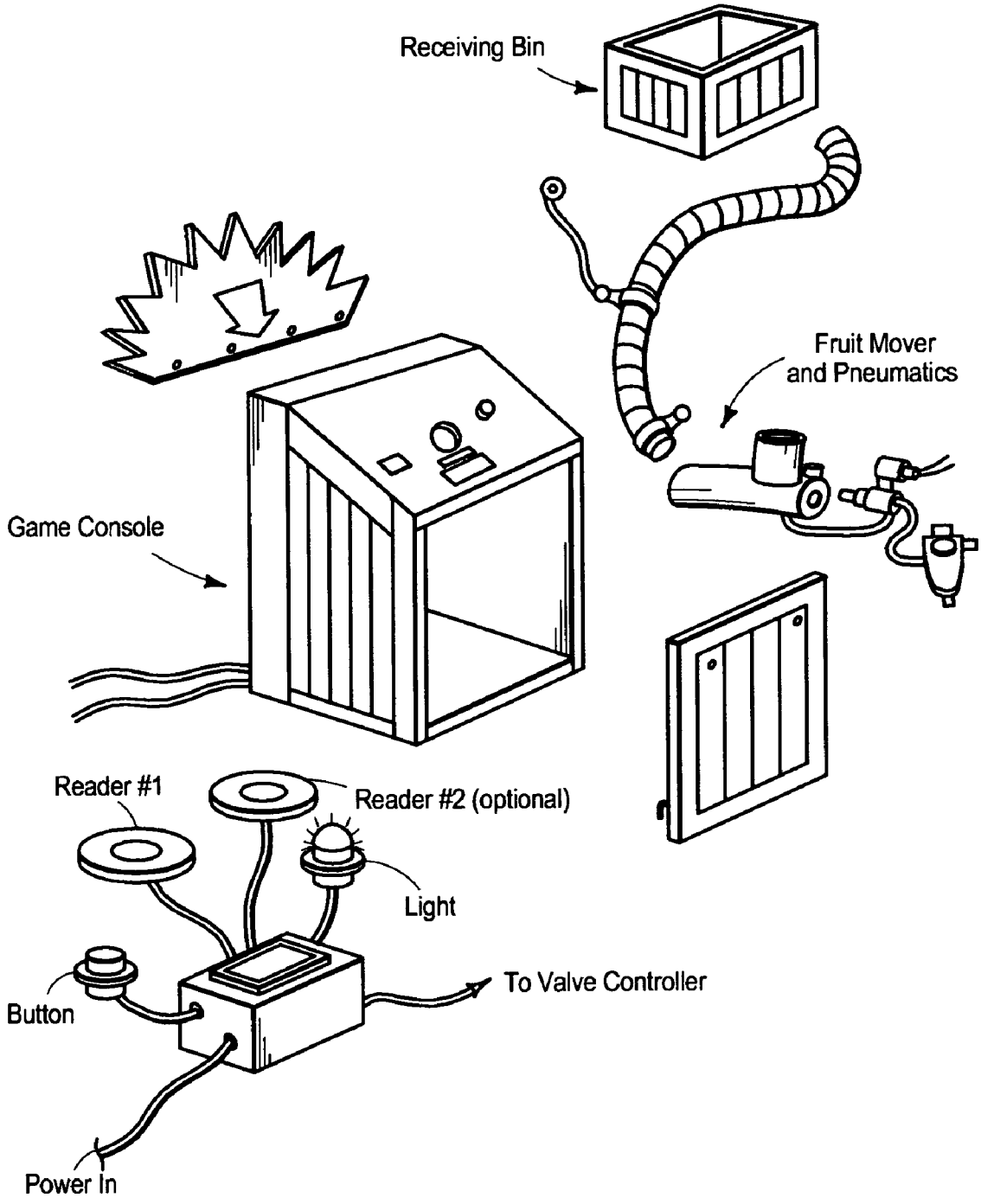
Figure 5F:
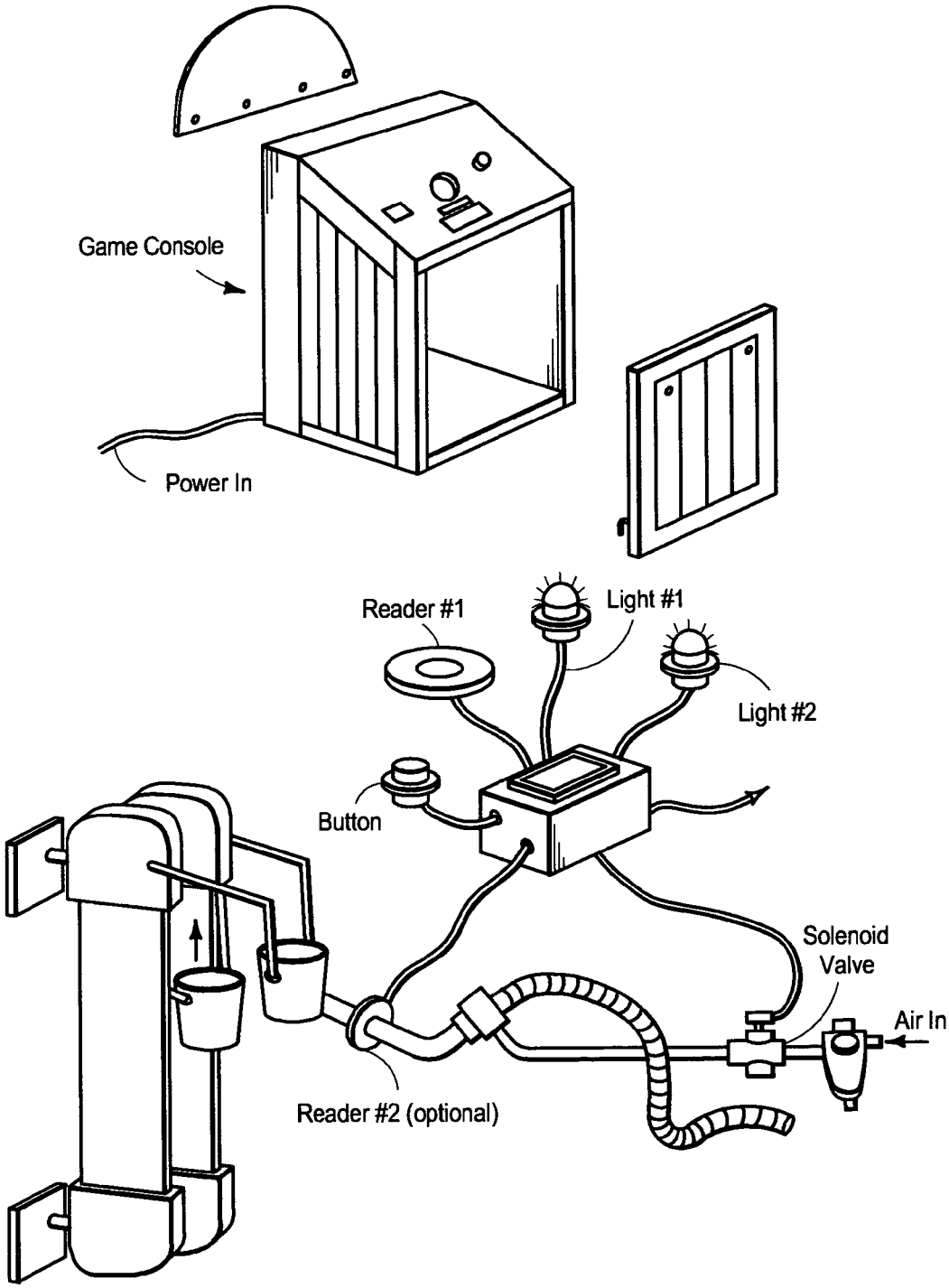

FIG. 4D illustrates a gate controlled area 225 of the play structure 100 that can preferably only be accessed by play participants 150 who have achieved a requisite number of points and/or completed particular requested task or challenge. Play participant's 105 actuate the gate 235 by presenting a card, key, or bracelet containing an RFID tag or other identifying device or feature. The gate 225 preferably only opens if the play participant has earned enough points and/or accomplished specific tasks or challenges in the course of the quest game play.

FIGS. 5A-F are perspective views and associated descriptions of various additional preferred embodiments of interactive quest game consoles having features and advantages in accordance with the present invention.

RFID Tags and Readers

As indicated above, each play participant 105 within the play structure 100 preferably receives an electronic identification device such as an RFID tag or transponder ("tag"). The tag allows play participants to electronically interact with the various quest consoles to achieve desired goals or produce desired effects within the play environment. Play participants preferably collect points or earn additional levels or ranks for each interactive console they successfully complete. In this manner, play participants 105 may compete with one another to see who can score more points and/or achieve the highest levels in the quest game.

At its most basic level, RFID provides a wireless link to uniquely identify objects or people. It is sometimes called dedicated short range communication (DSRC). RFID systems include electronic devices called transponders or tags, and reader electronics to communicate with the tags. These systems communicate via radio signals that carry data either unidirectionally (read only) or, more preferably, bi-directionally (read/write). One suitable RFID transponder is the 134.2 kHz/123.2 kHz, 23 mm Glass Transponder available from Texas Instruments, Inc. (http://www.tiris.com, Product No. RI-TRP-WRHP).

Figure 6A:
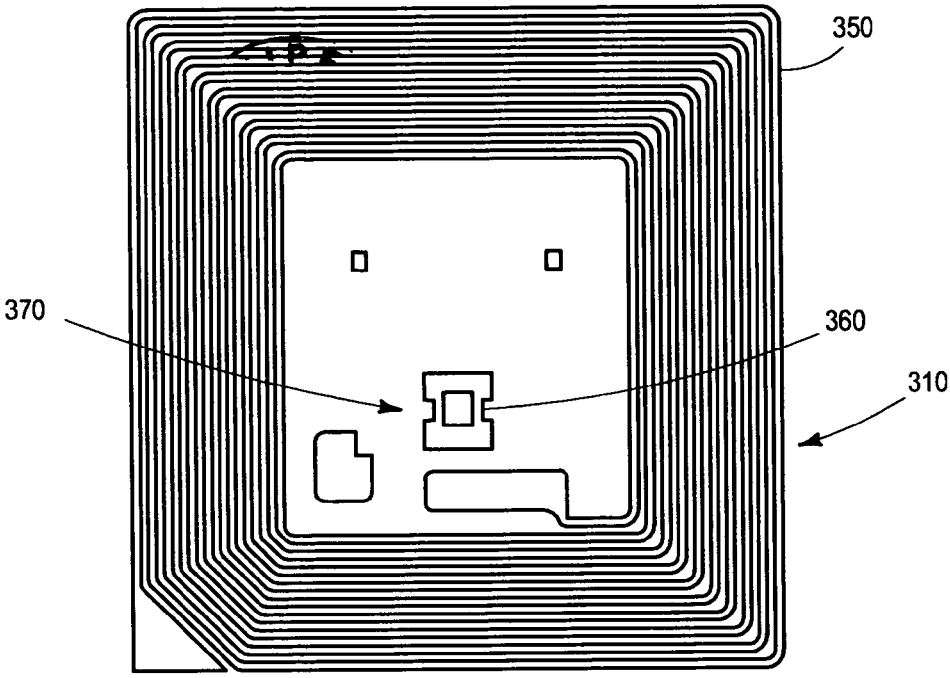
FIG. 6 is a detailed schematic view of one embodiment of an RFID tag device for use with in accordance with one preferred embodiment of an interactive quest game having features and advantages in accordance with the present invention.
Figure 6B:
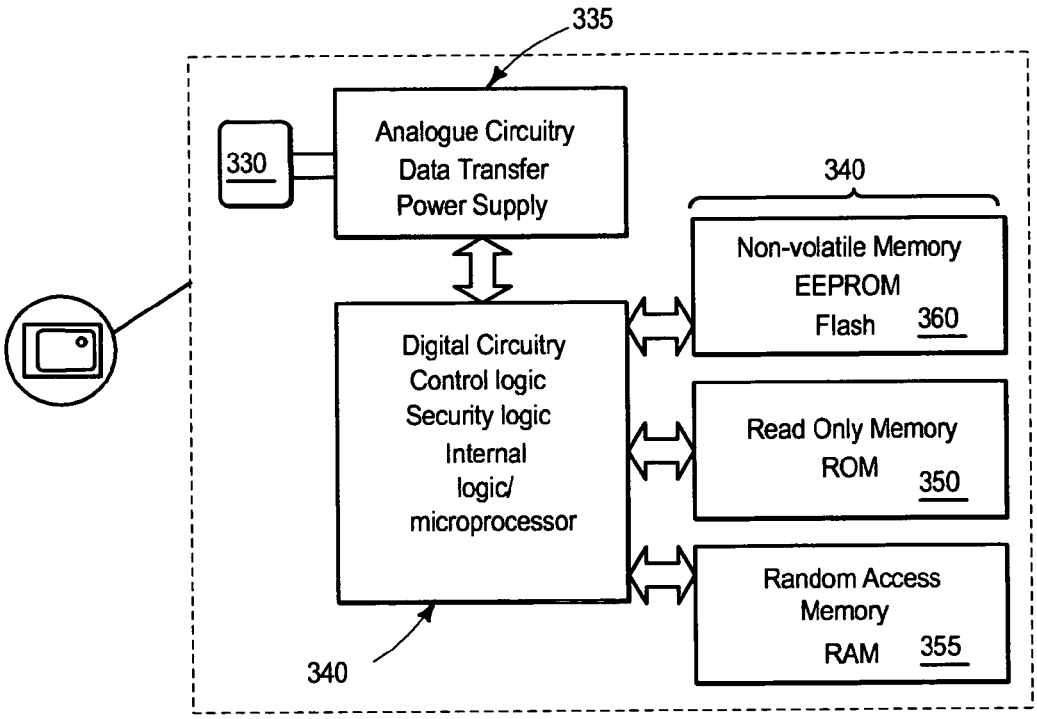

FIG. 6 is a detailed schematic view of an alternative embodiment of an RFID tag device 110 for use with one preferred embodiment of a quest game having features and advantages of the present invention. The tag 310 in the preferred embodiment illustrated preferably comprises a radio frequency tag pre-programmed with a unique person identifier number ("UPIN") or quest object identification number (UOIN). Other stored information (either pre-programmed or programmed later) may include, for example, the play participant's name, age, rank or level achieved, total points accumulated, tasks completed, facilities visited, etc. The tag 310 generally comprises a spiral wound antenna 350, a radio frequency transmitter chip 360 and various electrical leads and terminals 370 connecting the chip 360 to the antenna 350.

The tag may be a passive tag 310 or battery-powered, as expedience and costs dictate. Preferably, the tag 310 is passive (requires no batteries) so that it is inexpensive to purchase and maintain. Such tags and various associated readers and other accessories are commercially available in a wide variety of configurations, sizes and read ranges. RFID tags having a read range of between about 10 cm to about 100 cm are particularly preferred, although shorter or longer read ranges may also be acceptable. The particular tag 310 illustrated is the 13.56 mHz tag sold under the brand name Tagit™ available from Texas Instruments, Inc. (http://www.tiris.com, Product No. RI-103-110A). The tag 310 has a useful read/write range of about 25 cm and contains 256-bits of on-board memory arranged in 8×32-bit blocks which may be programmed (written) and read by a suitably configured read/write device. If a longer read/write range (e.g., 1-100 meters) and/or more memory (e.g., 1-100 Mb) is desired, optional battery-powered tags may be used instead, such as the AXCESS active RFID network system available from AXCESS, Inc. and/or various other RF-based asset and people tracking applications known to those skilled in the art.

Figure 7A:
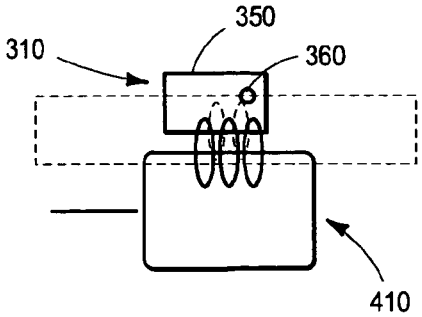
FIGS. 7A and 7B are schematic diagrams illustrating typical operation of the RFID tag device of FIG. 6.
Figure 7B:
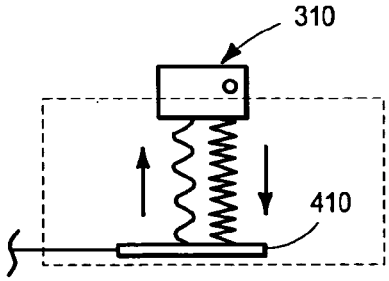

FIG. 7 is a simplified block diagram illustrating the basic organization and function of the electronic circuitry comprising the radio frequency transmitter chip 360 of the RFID tag device 310 of FIG. 2. The chip 360 basically comprises a central processor 430, Analogue Circuitry 435, Digital Circuitry 440 and on-board memory 445. On-board memory 445 is divided into read-only memory (ROM) 450, random access memory (RAM) 455 and non-volatile programmable memory 460, which is available for data storage. The ROM-based memory 450 is used to accommodate security data and the tag operating system instructions which, in conjunction with the processor 430 and processing logic deals with the internal "house-keeping" functions such as response delay timing, data flow control and power supply switching. The RAM-based memory 455 facilitates temporary data storage during transponder interrogation and response. The non-volatile programmable memory 460 may take various forms, electrically erasable programmable read only memory (EEPROM) being typical. It is used to store the transponder data and is preferably non-volatile to ensure that the data is retained when the device is in its quiescent or power-saving "sleep" state. Various data buffers or further memory components (not shown), may be provided to temporarily hold incoming data following demodulation and outgoing data for modulation and interface with the transponder antenna 350. Analog Circuitry 335 provides the facility to direct and accommodate the interrogation field energy for powering purposes in passive transponders and triggering of the transponder response. Analog Circuitry also provides the facility to accept the programming or "write" data modulated signal and to perform the necessary demodulation and data transfer processes. Digital Circuitry 440 provides certain control logic, security logic and internal microprocessor logic required to operate central processor 430.

Advantageously, the UPIN stored on each tag 310 may be used to wirelessly identify and track individual play participants 105 within a play facility or park. Optionally, each tag 310 may also include a unique group identifier number or "UGIN" which may be used to match one or more play participants to a defined group or team. If desired, the tag 310 may be covered with an adhesive paper label (not shown) for surface adhesion to a quest object, clothes, or any other tag bearing surface. More preferably, the tag 310 may be molded and/or embedded into a relatively stiff plastic sheet substrate and/or transponder cylinder which holds and supports the tag 310. Optionally, the sheet substrate, transponder or other support structure may take on any other fanciful shape, as desired. The resulting structures may be inserted into and/or affixed to the various quest objects, and/or they may be worn externally by play participants (e.g., as a bracelet, necklace, key chain trinket, sticker, name badge, etc.).

In operation, various RFID reader (and/or reader/writer) devices are provided and may be distributed throughout the play structure 100. These readers are able to read the information stored on each tag 310 when the associated person or object is brought into suitable proximity of the reader (1-100 cm). Advantageously, because radio waves can easily penetrate solid objects, such as plastic and the like, the tag 310 can be mounted internally within a cavity of the quest object, thereby providing an internal communication and information storage means for each quest object. Tags can also be worn close to the body, such as around a person's wrist. Thus, the UPIN, UOIN and UGIN information can be conveniently read and easily communicated to a quest console, computer monitor, interactive game control system, display system or other tracking, recording or displaying device for purposes of identifying, logging and creating a record of each play participant's experience. Additional information (e.g., unique personality traits, special powers, skill levels, etc.) can also be easily stored on each tag, thus providing further character development and interactive gaming possibilities.

Figure 8:
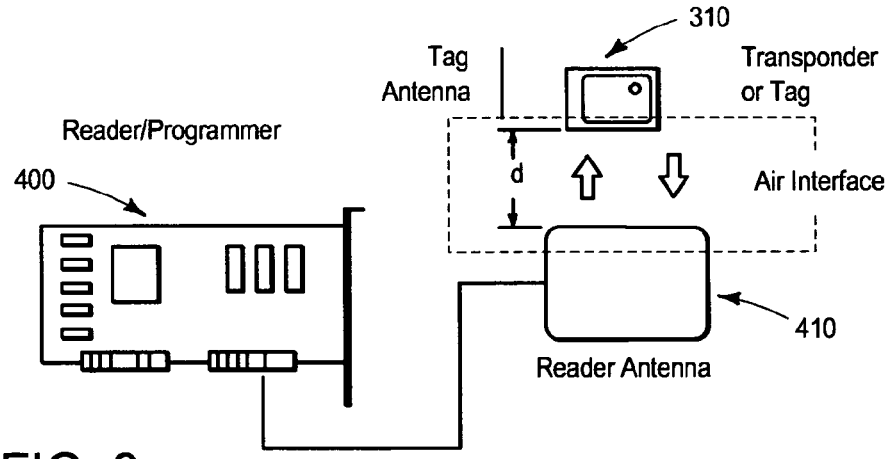
FIG. 8 is a simplified schematic diagram of an RFID read/write system for use with the RFID tag device of FIG. 6 and having features and advantages in accordance with the present invention.
Figure 9:
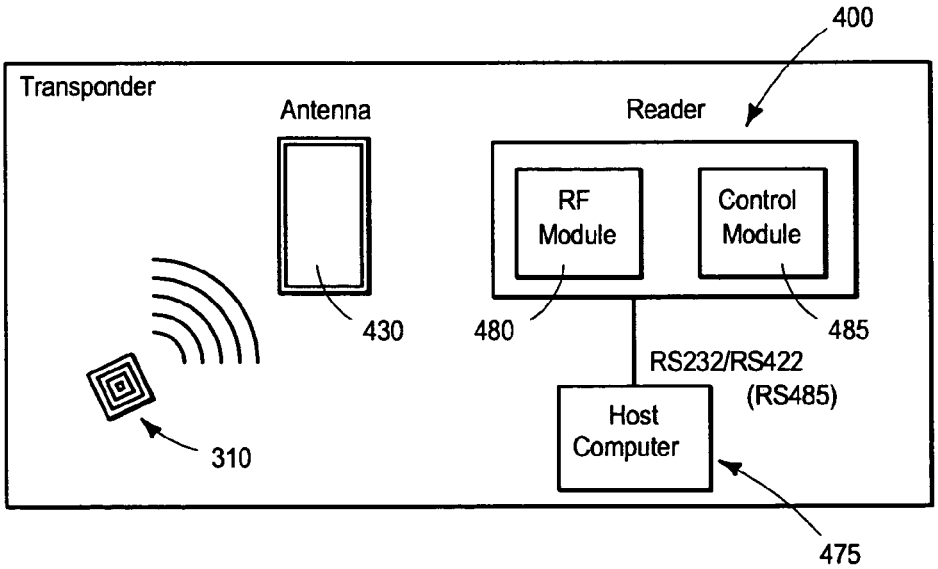
FIG. 9 is a simplified block diagram illustrating the basic organization and function of the electronic circuitry comprising the RFID tag device of FIG. 6.

FIGS. 8 and 9 are simplified schematic illustrations of tag and reader operation. The tag 310 is initially activated by a radio frequency signal broadcast by an antenna 410 of an adjacent reader or activation device 400. The signal impresses a voltage upon the antenna 350 by inductive coupling which is then used to power the chip 360 (see, e.g., FIG. 6). When activated, the chip 360 transmits via radio frequency a unique identification number preferably corresponding to the UPIN, UOIN and/or UGIN described above (see, e.g., FIG. 6 and associated discussion). The signal may be transmitted either by inductive coupling or, more preferably, by propagation coupling over a distance "d" determined by the range of the tag/reader combination. This signal is then received and processed by the associated reader 400, as described above, and then communicated to a host computer 475. If desired, the RFID tag or transponder 310 may also be configured for read/write communications with an associated reader/writer. Thus, the unique tag identifier number (UPIN, UGIN or UOIN) and any other stored information can be read, changed or other information may be added.

As indicated above, communication of data between a tag and a reader is by wireless communication. As a result, transmitting such data is possibly subject to the vagaries and influences of the media or channels through which the data has to pass, including the air interface. Noise, interference and distortion are potential sources of data corruption that may arise. Thus, those skilled in the art will appreciate that a certain degree of care preferably should be taken in the placement and orientation of the various readers 400 so as to minimize the probability of such data transmission errors. Preferably, the readers are placed at least 30-60 cm away from any metal objects, power lines or other potential interference sources. Those skilled in the art will also recognize that the write range of the tag/reader combination is typically somewhat less (~10-15% less) than the read range "d" and, thus, this should also be taken into account in determining optimal placement and positioning of each reader device 400.

Typical RFID data communication is asynchronous or unsynchronized in nature and, thus, particular attention should be given in considering the form in which the data is to be communicated. Structuring the bit stream to accommodate these needs, such as via a channel encoding scheme, is preferred in order to provide reliable system performance. Various suitable channel encoding schemes, such as amplitude shift keying (ASK), frequency shift keying (FSK), phase shift keying (PSK) and spread spectrum modulation (SSM), are well know to those skilled in the art and will not be further discussed herein. The choice of carrier wave frequency is also important in determining data transfer rates. Generally speaking the higher the frequency the higher the data transfer or throughput rates that can be achieved. This is intimately linked to bandwidth or range available within the frequency spectrum for the communication process. Preferably, the channel bandwidth is selected to be at least twice the bit rate required for the particular application.

Figure 10:
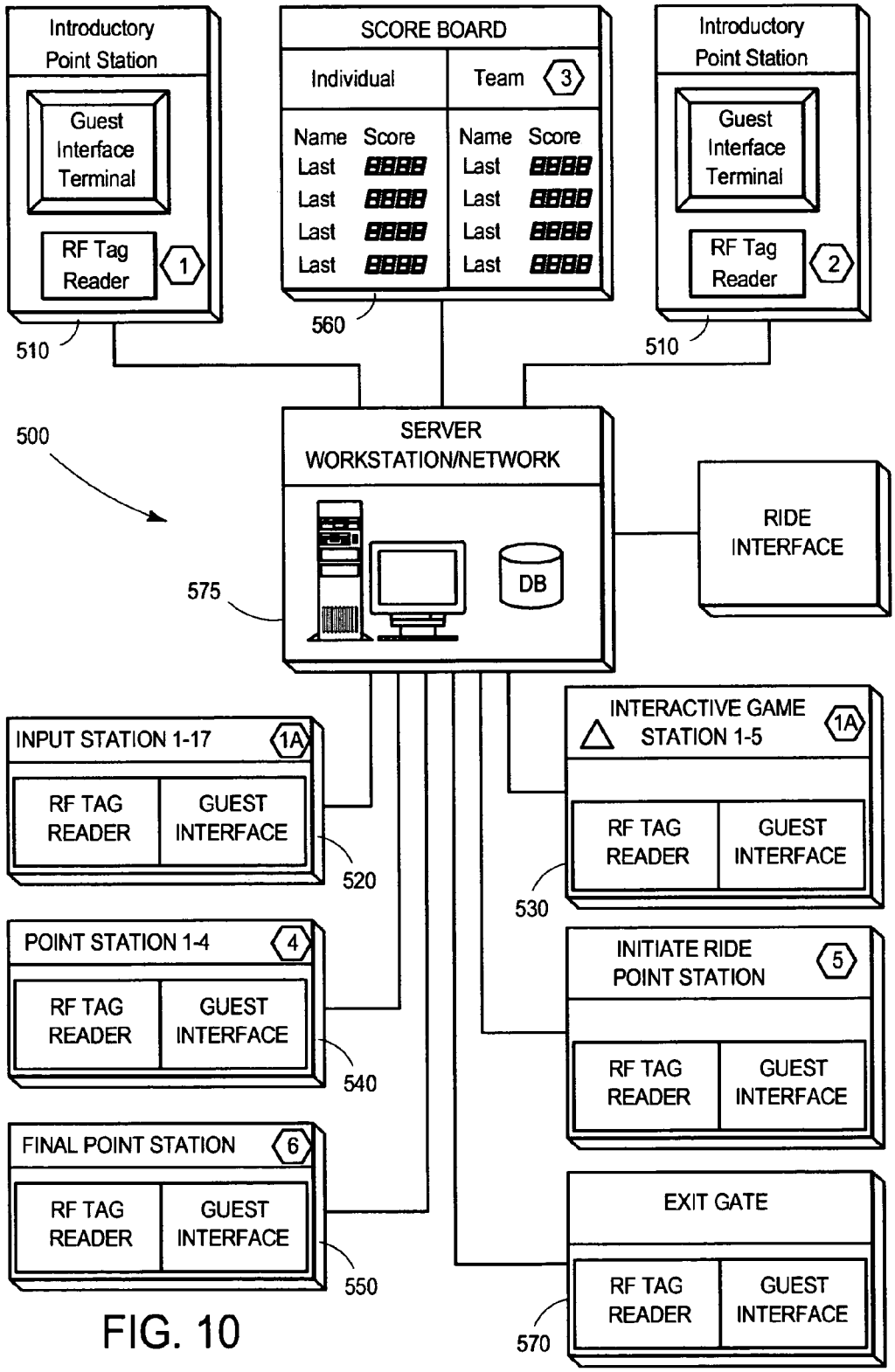
FIG. 10 is a schematic system layout of an interactive quest game system having features and advantages in accordance with the present invention.

FIG. 10 is a schematic system layout of one preferred embodiment of an interactive quest gaming system 500 having features and advantages in accordance with the present invention. Game play begins at the introductory point stations 510. Here play participants register to play the quest game, input relevant information about themselves, such as name, age, group affiliation. Play participants then proceed to the various input stations 520 and interactive game stations 530. The input stations 520 may comprise fruit sorters as described above and/or other game consoles requiring play participants within the context of the game to present an RFID band and/or other identifying information and to input or insert certain identified quest objects (either physical objects or virtual/representative objects). Interactive gaming stations 530 preferably comprise quest consoles that challenge play participants to complete a specified task (e.g., answer a multiple-choice question, push a button(s), jump over light beam sensor, or the like). Each input station 520 and interactive gaming station 530 preferably includes a guest interface (e.g. the push buttons or other things play participants operate) and an RF tag reader/writer or other play participant identifying means. Before play participants can operate the quest consol station, the RF Tag Reader/Writer first preferably reads the play participant's UPIN and/or UGIN and confirms the player's status. The console may then prompt the play participant to insert or choose one or more quest objects and/or to complete a requested task or challenge. Once the interface senses that the requested object(s) has been inserted or chosen and/or the requested task completed, the RF Tag Reader/Writer writes updated information to the play participant's RFID tag based on the play participant's performance in completing the task or challenge. This information may include, the identification of each station number visited, updated number of points accumulated, quest objects found, error check bits/flags and/or various other information pertinent to the game.

At any time during game play a play participant can choose to visit an optional dedicated point station 540 to determine his or her status in the game and the total points accumulated. The dedicated point stations may comprise a simple RF Tag Reader and associated display and/or it may include a guest interface, instructions for game play, and/or other desired functionality. A "final" point station 550 may be disposed at the end or exit of the quest game. Here players can verify and log their final point tally. The final point station 550 preferably includes a RF Tag Reader/Writer. Various software in the final point station may be used to log and verify the final recorded score and communicate such information to a main score board 560. Once the score has been logged and verified the final point station 550 preferably "resets" the play participant's RFID tag so that the play participant can turn in the RFID tag at the exit gate 570 to be used by another play participant.

Theming/Storyline

The present invention may be carried out using a wide variety of suitable themed play environments, storylines and characters, as will be readily apparent to those skilled in the art. The following specific example is provided for purposes of illustration and for better understanding of the invention and should not be taken as limiting the invention in any way:

EXAMPLE

Long ago, kids from the 1850's built a great machine to speed up the harvesting of fruits and vegetables, helping them to finish their work earlier so they could play on a secret super slide. They built the machine out of old parts they found on the farm. Kids feed the machine fruits and vegetables and the machine harvests it for them automatically.

Guests in the barn play structure wear harvest aprons that have RFID tags sewn in (and/or they wear a special RFID bracelet/band). The object of the Barnyard Quest game is to collect as many fruits and vegetables as possible as part of an overall harvest and to put them into numerous collection stations that feed the great machine. But, as the kids will discover, only certain fruits and vegetables will work in certain collection stations. Guests work their way through the play experience doing various activities that earn them points along the wan. They eventually work their way up to the highest level where, if they have accumulated enough points, they are allowed to slide down the secret super slide. The slide has special effects, such as sound, lighting, etc. that provide a special surprise and thrill to kids lucky enough to slide down. Preferably, there are three different levels of special effects, depending on how many points a play participant has accumulated. To get the maximum effects, play participants must accumulate the most points.

On the ground floor, the base of the great machine is surrounded by bins of fruits and vegetables. The bins serve as temporary storage vessels for fruits and vegetables inserted into the various collection stations above. The game is self-recycling in that guests continually must retrieve fruits and vegetables from the storage bins, carry them up to the upper levels and insert them into the various collection stations. Guests collect the various fruits and vegetables and try to find the correct input stations where they are to be inserted to feed the great machine. Points are awarded for placing fruit/vegetables in the correct input stations. No points (or, optionally, negative points) are awarded for inserting an incorrect fruit/vegetable. Guests can also score points by successfully completing various interactive games distributed throughout the barn, such as bug smashing, cow milking, hay tossing, etc.

The quest game in accordance with the above-described example provides a challenging, computer-orchestrated interactive gaming experience within a physical play space using electronically-identifiable physical objects as an interactive play medium. The game provides kids with the intellectual challenge and excitement of a computer adventure game, but with tangible interactives, physical challenges, and social interaction.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. A method of interactive game play wherein play participants participate in a computer driven game, the method comprising:

providing a physical play structure comprising at least one of a plurality of rooms and a plurality of play structure levels configured to accommodate a plurality of play participants concurrently during an interactive game;

providing a plurality of electronically identifiable objects for use by a play participant of the plurality of play participants in the interactive game;

providing one or more challenges within the interactive game to the play participant at a plurality of consoles in respective rooms or play structure levels of the play structure during performance of the interactive game;

receiving with each of the plurality of consoles selected ones of the plurality of electronically identifiable objects deposited in the console by the play participant to complete at least one of the one or more challenges, each of the plurality of consoles being provided within at least one of the plurality of rooms or the plurality of play structure levels of the physical play structure;

wirelessly receiving with at least two of the plurality of consoles at respective rooms or play structure levels a unique player identification from an identification device associated with the play participant during portions of the interactive game, which respective portions of the interactive game are played at respective rooms or play structure levels, the identification device being different than the plurality of electronically identifiable objects;

tracking an amount of the plurality of electronically identifiable objects deposited in appropriate ones of the plurality of consoles at the respective rooms or play structure levels during the one or more challenges of the interactive game, wherein said tracking the amount comprises electronically identifying a property of each electronically identifiable object deposited in an appropriate one of the plurality of consoles;

transporting the deposited electronically identifiable objects to a collection console at a respective room or play structure level in communication with the plurality of consoles; and tracking a progress of the play participant in completion of the challenges during the interactive game, said tracking comprising electronically associating the unique player identification with the amount of the plurality of electronically identifiable objects deposited in appropriate ones of the plurality of consoles at the respective rooms or play structure levels.

2. The method of claim 1, wherein the property comprises at least one of shape, size and weight.

3. The method of claim 1, wherein the property comprises a color.

4. The method of claim 1, wherein the property comprises identification data stored in a radio frequency identification (RFID) tag associated with the electronically identifiable object.

5. The method of claim 1, wherein said tracking the progress comprises awarding points to the play participant based at least on the amount of the plurality of electronically identifiable objects deposited in appropriate ones of the plurality of consoles.

6. The method of claim 5, additionally comprising displaying the points of the play participant on a central display in the physical play structure.

7. The method of claim 1, wherein said transporting comprises utilizing a pneumatic system.

8. The method of claim 1, wherein said tracking the amount is performed at the collection console.

9. The method of claim 1, wherein providing the plurality of electronically identifiable objects comprises distributing the plurality of electronically identifiable objects throughout the physical play structure for discovery by the play participant.

10. The method of claim 1, wherein providing the one or more challenges to the play participant comprises providing the play participant access to a second challenge at a second console only after the play participant has completed a first challenge at a first console.

11. An interactive game for providing challenges to a plurality of game participants, the interactive game comprising:

a plurality of electronically identifiable objects for use in completing one or more challenges of an interactive game;

a physical play structure comprising at least one of a plurality of rooms and a plurality of play structure levels sized to accommodate a plurality of game participants in the interactive game;

a plurality of consoles each positioned within the at least one of the plurality of rooms and the plurality of play structure levels of the physical play structure, each of the plurality of consoles configured to receive certain ones of the plurality of electronically identifiable objects from the plurality of game participants in the performance of the one or more challenges in respective rooms or play level structures of the play structure, each of the plurality of consoles being further configured to identify a property of each electronically identifiable object deposited in the console;

a plurality of identification devices different than the plurality of electronically identifiable objects, each of the plurality of identification devices associating one of the plurality of game participants with a unique identifier and being configured to wirelessly communicate the unique identifier to at least one electronic reader, the at least one electronic reader being located in a respective room or play structure level of the play structure;

a database configured to track a progress of each of the plurality of game participants in completion of the challenges, wherein said progress is indicative of an amount of the plurality of electronically identifiable objects deposited in appropriate ones of the plurality of consoles during the performance of the one or more challenges;

a collection console located at a respective room or play structure level of the play structure; and a plurality of conduits within the play structure in communication with the collection console and the plurality of consoles, the plurality of conduits being configured to transport the electronically identifiable objects deposited in the appropriate ones of the plurality of consoles to the collection console.

12. The interactive game of claim 11, wherein a second challenge of the one or more challenges at a second console is accessible to at least one of the plurality of game participants only after the at least one game participant has completed a first challenge of the one or more challenges at a first console.

13. The interactive game of claim 11, wherein the plurality of consoles comprises a plurality of bins.

14. The interactive game of claim 11, wherein the plurality of electronically identifiable objects comprises at least one of plastic objects, foam objects and rubber objects.

15. The interactive game of claim 14, wherein the plurality of electronically identifiable objects comprises objects in shapes of fruits or vegetables.

16. The interactive game of claim 14, wherein the plurality of electronically identifiable objects comprises balls.

17. The interactive game of claim 11, wherein the plurality of consoles are positioned within the plurality of rooms or play structure levels.

18. The interactive game of claim 11, wherein each of the plurality of identification devices is configured to be worn by the associated game participant.

19. The interactive game of claim 11, wherein the plurality of conduits utilize a pneumatic configuration to transport the portion of the deposited electronically identifiable objects from the plurality of consoles to the collection console.

20. An interactive game comprising:

a physical play structure comprising a plurality of play modules configured to accommodate a plurality of play participants concurrently in an interactive game;

a plurality of electronically identifiable objects for use in completing a plurality of challenges of the interactive game, the challenges being played at respective play modules of the play structure, by a play participant of the plurality of play participants in the interactive game;

a plurality of consoles disposed within the plurality of play modules of the physical play structure, each of the plurality of consoles configured to receive certain ones of the plurality of electronically identifiable objects deposited in the console by the play participant in the performance of at least one of the plurality of challenges at the respective play modules of the play structure, each of the plurality of consoles being further configured to identify a property of each electronically identifiable object deposited in the console;

an identification device different from the plurality of electronically identifiable objects, the identification device storing a unique identifier associated with the play participant, the identification device being further configured to wirelessly communicate the unique identifier to at least one electronic reader at each of the plurality of consoles at the respective play modules of the play structure; and a database configured to track a progress of the play participant, wherein said progress is indicative of an amount of the plurality of electronically identifiable objects deposited in appropriate ones of the plurality of consoles during the performance of the plurality of challenges at the respective play modules of the play structure, and wherein a second challenge of the plurality of challenges at a second console is accessible to the play participant only after the play participant has completed a first challenge of the plurality of challenges at a first console.

* * * * *

UNITED STATES PATENT AND TRADEMARK OFFICE

CERTIFICATE OF CORRECTION

PATENT NO. : 7,614,958 B2
APPLICATION NO. : 10/298170
DATED : November 10, 2009
INVENTOR(S) : Weston et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 884 days.

Signed and Sealed this

Nineteenth Day of October, 2010

David J. Kappos

David J. Kappos
*Director of the United States Patent and Trademark Office*